US011741890B2

(12) United States Patent
Ryoo et al.

(10) Patent No.: US 11,741,890 B2
(45) Date of Patent: Aug. 29, 2023

(54) POWER SUPPLIER CIRCUIT AND DISPLAY DEVICE INCLUDING THE SAME

(71) Applicant: LG DISPLAY CO., LTD., Seoul (KR)

(72) Inventors: SeungSeok Ryoo, Seoul (KR); Byeong-Seong So, Seoul (KR)

(73) Assignee: LG Display Co., Ltd., Seoul (KR)

( * ) Notice: Subject to any disclaimer, the term of this patent is extended or adjusted under 35 U.S.C. 154(b) by 0 days.

(21) Appl. No.: 17/952,013

(22) Filed: Sep. 23, 2022

(65) Prior Publication Data

US 2023/0169913 A1 Jun. 1, 2023

(30) Foreign Application Priority Data

Nov. 30, 2021 (KR) ..... 10-2021-0169468

(51) Int. Cl.
*G09G 3/3266* (2016.01)
*G09G 3/32* (2016.01)

(52) U.S. Cl.
CPC ..... *G09G 3/32* (2013.01); *G09G 2300/0426* (2013.01); *G09G 2300/0876* (2013.01); *G09G 2310/08* (2013.01); *G09G 2330/028* (2013.01)

(58) Field of Classification Search
CPC ..... G09G 3/32; G09G 2300/0426; G09G 2300/0876; G09G 2310/08; G09G 2330/028; G09G 3/3266; G09G 3/3233
See application file for complete search history.

(56) References Cited

U.S. PATENT DOCUMENTS

2020/0184899 A1 6/2020 Lee et al.
2020/0226978 A1 7/2020 Lin et al.
2021/0125560 A1 4/2021 Park et al.
2021/0202595 A1 7/2021 Lee et al.
2021/0202623 A1 7/2021 Lee et al.
2021/0366402 A1 11/2021 In et al.
2021/0383760 A1* 12/2021 In ..... G09G 3/3266
2022/0180810 A1 6/2022 Zhang et al.
2022/0351659 A1* 11/2022 Kwon ..... G09G 3/3233

FOREIGN PATENT DOCUMENTS

CN 112397026 A 2/2021

OTHER PUBLICATIONS

European Patent Office, Extended European Search Report and Opinion, EP Patent Application No. 22197592.3, dated Apr. 18, 2023, 15 pages.

* cited by examiner

*Primary Examiner* — Abdul-Samad A Adediran
(74) *Attorney, Agent, or Firm* — Fenwick & West LLP

(57) ABSTRACT

The present disclosure relates to a power supply device including a gate driving circuit configured to supply gate signals to a plurality of gate lines, a first power supply circuit configured to supply a first initialization voltage having a voltage level between a first voltage level and a second voltage level to a plurality of first initialization power lines, the first initialization voltage having the first voltage level in a first period, a third voltage level between the first and second voltage levels in a second period, and the second voltage level in a third period, and a second power supply circuit configured to supply a driving voltage to a plurality of driving power lines among the plurality of power lines, and a display device including the power supply device.

20 Claims, 19 Drawing Sheets

POWER SUPPLIER CIRCUIT AND DISPLAY DEVICE INCLUDING THE SAME

CROSS-REFERENCE TO RELATED APPLICATION

This application claims the priority benefit of Republic of Korea Patent Application No. 10-2021-0169468, filed on Nov. 30, 2021 in the Korean Intellectual Property Office, which is incorporated by reference in its entirety.

BACKGROUND

Field of the Disclosure

The present disclosure relates to electronic devices, and more specifically, to a power supply circuit and a display device including the power supply circuit.

Description of the Background

As the information-oriented society has been developed, various needs for display devices for displaying an image have increased. To satisfy such needs, various types of display devices, such as a liquid crystal display (LCD) device, an electroluminescence display (ELD) device, and the like have been developed and utilized.

The ELD device includes a quantum-dot light emitting display device including a quantum dot (QD), an inorganic light emitting display device, and an organic light emitting display device, and the like.

Among these display devices, the ELD device has characteristics of a short response time, a wide viewing angle, excellent color gamut, and the like. Further, the ELD device has an advantage that can be implemented as a thin package or structure.

Further, since the ELD device displays an image through light emitted by a driving current, an amount of driving current is small or the driving current does not flow at a low gray scale or a black gray scale. As a result, the ELD device has advantages of high contrast ratio at low luminance, excellent image quality, and the like.

In the ELD device, a driving current can flow through a pixel included therein by a voltage applied to the driving transistor, and the amount of driving current can be determined to correspond to a data signal. In an instance where the voltage applied to the pixel is higher than a predefined value, the amount of driving current flowing through the pixel may not correspond to the data signal. In particular, in a situation where an image is displayed through a pixel at a low gray scale, the above issue may be increasingly present, and thus, the ELD device may have the disadvantage of producing deteriorated image quality.

In addition, recently, due to issues such as environmental protection and resource depletion, challenges have arisen in reducing the power consumption of electronic devices or equipment.

SUMMARY

To address such issues, embodiments of the present disclosure provide a power supply circuit or device capable of reducing or preventing the deterioration of image quality, and a display device including the power supply circuit or device.

Embodiments of the present disclosure provide a power supply circuit or device capable of reducing power consumption, and a display device including the power supply circuit or device.

In one embodiment, a display device comprises: a display panel that comprises a plurality of gate lines, a plurality of data lines, a plurality of first initialization power lines, a plurality of power lines, and a plurality of pixels connected to the plurality of gate lines, the plurality of data lines, the plurality of first initialization power lines, and the plurality of power lines, the plurality of pixels configured to emit light during a light emission period of the display device; a data driving circuit configured to supply data signals to the plurality of data lines; a gate driving circuit configured to supply gate signals to the plurality of gate lines; a first power supply circuit configured to supply a first initialization voltage having a voltage level that changes between a first voltage level and a second voltage level to the plurality of first initialization power lines; and a second power supply circuit configured to supply a pixel driving voltage to a plurality of pixel driving power lines among the plurality of power lines, wherein at least one pixel of the plurality of pixels comprises: a driving transistor for enabling a driving current to flow from a second node to a third node in response to a voltage of a first node to which a voltage corresponding to a data signal is applied; and a light emitting element for emitting light in response to the driving current, and wherein while the light emitting element does not emit the light prior to the light emission period, the voltage corresponding to the data signal is applied to the first node, and thereafter, the second node and the third node are initialized using the first initialization voltage, the first initialization voltage having the first voltage level in a first period, a third voltage level between the first voltage level and the second voltage level in a second period that is subsequent the first period, and the second voltage level in a third period that is subsequent the second period.

In one embodiment, a power supply device comprises: a plurality of stages configured to generate a first initialization voltage and a carry signal that are sequentially output by each of the plurality of stages, wherein the first initialization voltage output from each of the plurality of stages has a voltage level between a first voltage level and a second voltage level, and has the first voltage level in a first period, a third voltage level between the first voltage level and the second voltage level in a second period that is subsequent the first period, and the second voltage level in a third period that is subsequent the second period.

In one embodiment, a pixel comprises: a driving transistor including a first node, a second node that is configured to be electrically connected between a data line to which a data signal is applied and a pixel driving line to which a pixel driving voltage is applied, and a third node, the driving transistor configured to enable a driving current to flow from the second node to the third node responsive to the data signal being applied to the first node; and a light emitting element electrically connected to the third node of the driving transistor, the light emitting element configured to emit light responsive to the driving current, wherein after the data signal is applied to the first node of the driving transistor, a first initialization voltage is applied to the second node and the third node of the driving transistor to initialize the second node and the third node while the light emitting element does not emit light prior to a light emission period of the pixel, the first initialization voltage having a first voltage level in a first period, a third voltage level between the first voltage level and a second voltage level in a second period that is subsequent the first period, and the second voltage level in a third period that is subsequent the second period.

According to embodiments of the present disclosure, provided there are the power supply circuit or device capable of reducing the deterioration of image quality, and the display device including the power supply circuit or device.

According to embodiments of the present disclosure, provided there are the power supply circuit or device capable of reducing power consumption, and the display device including the power supply circuit or device.

BRIEF DESCRIPTION OF THE DRAWINGS

The accompanying drawings, which are included to provide a further understanding of the disclosure and are incorporated in and constitute a part of the disclosure, illustrate aspects of the disclosure and together with the description serve to explain the principle of the disclosure. In the drawings.

DETAILED DESCRIPTION

Figure 1A:
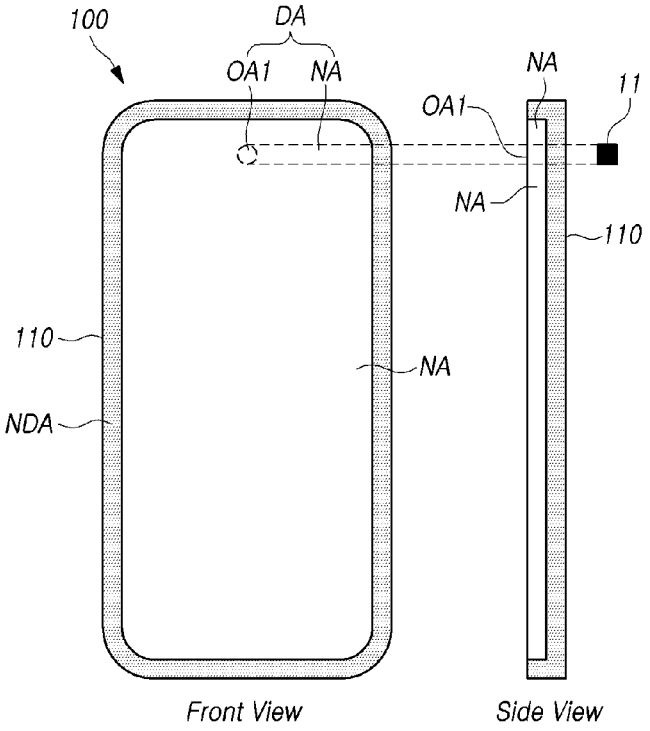
FIGS. 1A, 1B and 1C are plan views illustrating a display device according to embodiments of the present disclosure.

In the following description of examples or embodiments of the present disclosure, reference will be made to the accompanying drawings in which it is shown by way of illustration specific examples or embodiments that can be implemented, and in which the same reference numerals and signs can be used to designate the same or like components even when they are shown in different accompanying drawings from one another. Further, in the following description of examples or embodiments of the present disclosure, detailed descriptions of well-known functions and components incorporated herein will be omitted when it is determined that the description may make the subject matter in some embodiments of the present disclosure rather unclear. The terms such as "including", "having", "containing", "constituting" "make up of", and "formed of" used herein are generally intended to allow other components to be added unless the terms are used with the term "only". As used herein, singular forms are intended to include plural forms unless the context clearly indicates otherwise.

Terms, such as "first", "second", "A", "B", "(A)", or "(B)" may be used herein to describe elements of the present disclosure. Each of these terms is not used to define essence, order, sequence, or number of elements etc., but is used merely to distinguish the corresponding element from other elements.

When it is mentioned that a first element "is connected or coupled to", "contacts or overlaps" etc. a second element, it should be interpreted that, not only can the first element "be directly connected or coupled to" or "directly contact or overlap" the second element, but a third element can also be "interposed" between the first and second elements, or the first and second elements can "be connected or coupled to", "contact or overlap", etc. each other via a fourth element. Here, the second element may be included in at least one of two or more elements that "are connected or coupled to", "contact or overlap", etc. each other.

When time relative terms, such as "after," "subsequent to," "next," "before," and the like, are used to describe processes or operations of elements or configurations, or flows or steps in operating, processing, manufacturing methods, these terms may be used to describe non-consecutive or non-sequential processes or operations unless the term "directly" or "immediately" is used together.

In addition, when any dimensions, relative sizes etc. are mentioned, it should be considered that numerical values for an elements or features, or corresponding information (e.g., level, range, etc.) include a tolerance or error range that may be caused by various factors (e.g., process factors, internal or external impact, noise, etc.) even when a relevant description is not specified. Further, the term "may" fully encompasses all the meanings of the term "can".

Figure 1B:
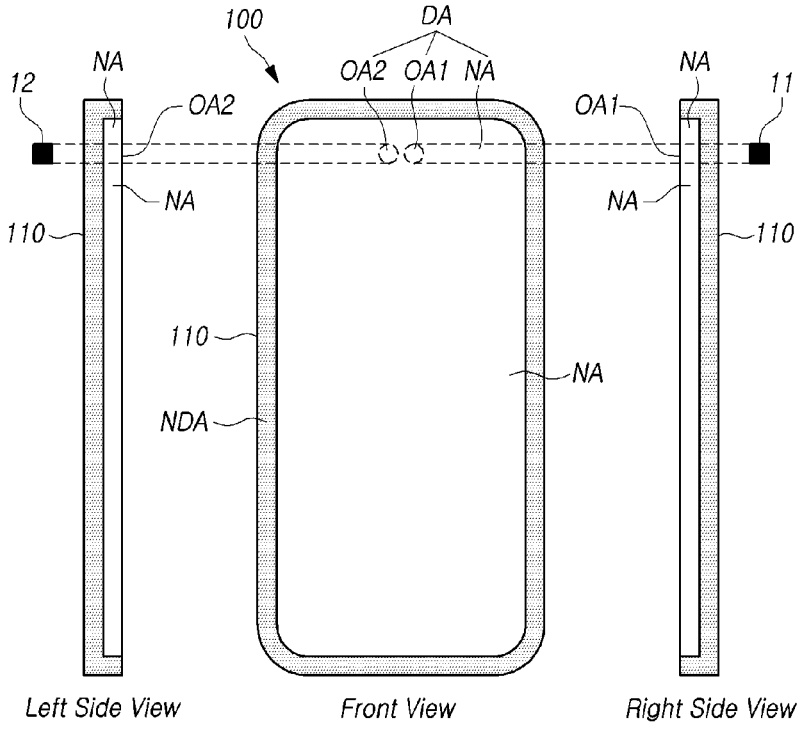
Figure 1C:
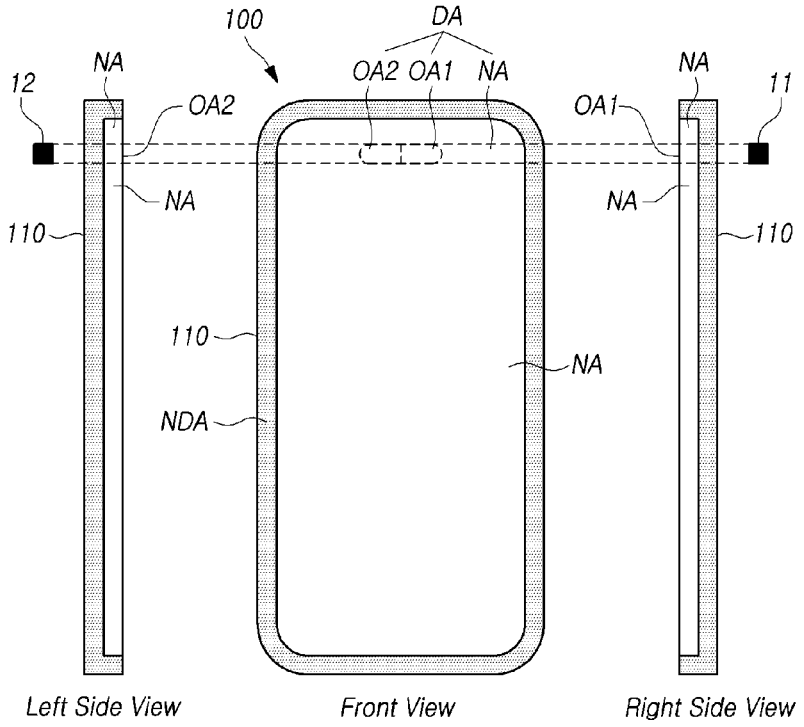

FIGS. 1A, 1B and 1C are plan views illustrating an example display device according to embodiments of the present disclosure.

Referring to FIGS. 1A, 1B, and 1C, a display device 100 according to embodiments of the present disclosure can include a display panel 110 for displaying images, and one or more optical electronic devices (11, 12).

The display panel 110 can include a display area DA in which an image is displayed and a non-display area NDA in which an image is not displayed.

A plurality of pixels can be arranged in the display area DA, and several types of signal lines for driving the plurality of pixels can be arranged therein.

The non-display area NDA may refer to an area outside of the display area DA. Several types of signal lines can be arranged in the non-display area NDA, and several types of driving circuits can be connected thereto. At least a portion of the non-display area NDA may be bent to be invisible from the front of the display panel or may be covered by a case (not shown) of the display panel 110 or the display device 100. The non-display area NDA may be also referred to as a bezel or a bezel area.

Referring to FIGS. 1A, 1B, and 1C, in the display device 100 according to embodiments of the present disclosure, the one or more optical electronic devices (11, 12) may be located under, or in a lower portion of, the display panel 110 (an opposite side of a viewing surface thereof).

Light can enter the front surface (viewing surface) of the display panel 110, pass through the display panel 110, reach the one or more optical electronic devices (11, 12) located under, or in the lower portion of, the display panel 110 (the opposite side to the viewing surface).

The one or more optical electronic devices (11, 12) can receive or detect light transmitting through the display panel 110 and perform a predefined function based on the received light. For example, the one or more optical electronic devices (11, 12) may include one or more of an image capture device such as a camera (an image sensor), and/or the like, and a sensor such as a proximity sensor, an illuminance sensor, and/or the like.

Referring to FIGS. 1A, 1B, and 1C, in some embodiments, the display area DA of the display panel 110 may include one or more optical areas (OA1, OA2) and a normal area NA. The normal area NA is an area that does not overlap with one or more optical electronic devices (11, 12) and may also be referred to as a non-optical area.

Referring to FIGS. 1A, 1B, and 1C, the one or more optical areas (OA1, OA2) may be one or more areas overlapping the one or more optical electronic devices (11, 12).

According to an example of FIG. 1A, the display area DA may include a first optical area OA1 and a normal area NA. In some embodiments, at least a portion of the first optical area OA1 may overlap a first optical electronic device 11. Herein, the normal area NA is an area that does not overlap one or more optical electronic devices (11, 12) and may also be referred to as a non-optical area or a typical display area.

According to an example of FIG. 1B, the display area DA may include a first optical area OA1, a second optical area OA2, and a normal area NA. In the example of FIG. 1B, at least a portion of the normal area NA may be present between the first optical area OA1 and the second optical area OA2. In some embodiments, at least a portion of the first optical area OA1 may overlap the first optical electronic device 11, and at least a portion of the second optical area OA2 may overlap a second optical electronic device 12.

According to an example of FIG. 1C, the display area DA may include a first optical area OA1, a second optical area OA2, and a normal area NA. In the example of FIG. 1C, the normal area NA may not be present between the first optical area OA1 and the second optical area OA2. For example, the first optical area OA1 and the second optical area OA2 may contact each other. In some embodiments, at least a portion of the first optical area OA1 may overlap the first optical electronic device 11, and at least a portion of the second optical area OA2 may overlap the second optical electronic device 12.

Both an image display structure and a light transmission structure are needed to be formed in the one or more optical areas (OA1, OA2). In some embodiments, since the one or more optical areas (OA1, OA2) are one or more portions of the display area DA, pixels for displaying images are needed to be disposed in the one or more optical areas (OA1, OA2). Further, to enable light to transmit the one or more optical electronic devices (11, 12), a light transmission structure is needed to be formed in the one or more optical areas (OA1, OA2).

According to the embodiments described above, in spite of the fact that the one or more optical electronic devices (11, 12) are needed to receive or detect light, the one or more optical electronic devices (11, 12) are sometimes located on the back of the display panel 110 (under, or in the lower portion of, the display panel 110, i.e., an opposite side of a viewing surface), and thereby, can receive light that has transmitted the display panel 110.

For example, the one or more optical electronic devices (11, 12) may not be exposed in the front surface (viewing surface) of the display panel 110. Accordingly, when a user looks at the front of the display device 110, the one or more optical electronic devices (11, 12) are invisible to the user.

In one embodiment, the first optical electronic device 11 may be a camera, and the second optical electronic device 12 may be a sensor such as a proximity sensor, an illuminance sensor, and/or the like. For example, the sensor may be an infrared sensor capable of detecting infrared rays.

In another embodiment, the first optical electronic device 11 may be a sensor, and the second optical electronic device 12 may be a camera.

Hereinafter, for convenience of description, discussions will be conducted on the embodiment where the first optical electronic device 11 is a camera, and the second optical electronic device 12 is a sensor such as a proximity sensor, an illuminance sensor, an infrared sensor, and the like. For example, the camera may be a camera lens, an image sensor, or a unit including at least one of the camera lens and the image sensor.

In the example where the first optical electronic device 11 is a camera, this camera may be located on the back of (under, or in a lower portion of) the display panel 110, and be a front camera capable of capturing objects or images in a front direction of the display panel 110. Accordingly, the user can capture an image or object through the camera that is not visible on the viewing surface while looking at the viewing surface of the display panel 110.

Although the normal area NA and the one or more optical areas (OA1, OA2) included in the display area DA in each of FIGS. 1A to 1C are areas where images can be displayed, the normal area NA is an area that lacks a light transmission structure, but the one or more optical areas (OA1, OA2) are areas that include the light transmission structure.

Accordingly, the one or more optical areas (OA1, OA2) may have a transmittance greater than or equal to a predetermined level, (e.g., a relatively high transmittance), and the normal area NA may not have light transmittance or have a transmittance less than the predetermined level (e.g., a relatively low transmittance).

For example, the one or more optical areas (OA1, OA2) and the normal area NA may have different resolutions, pixel arrangement structures, numbers of pixels per unit area, electrode structures, line structures, electrode arrangement structures, line arrangement structures, and the like from each other.

In one embodiment, the number of pixels per unit area in the one or more optical areas (OA1, OA2) may be less than the number of pixels per unit area in the normal area NA. For example, the resolution of the one or more optical areas (OA1, OA2) may be less than that of the normal area NA. Here, the number of pixels per unit area can be measured using pixels per inch (PPI), which represents the number of pixels within 1 inch, as a unit for measuring resolution.

In one embodiment, in each of FIGS. 1A to 1C, the number of pixels per unit area in the first optical area OA1 may be less than the number of pixels per unit area in the normal area NA. In one embodiment, in each of FIGS. 1B and 1C, the number of pixels per unit area in the second optical area OA2 may be greater than or equal to the number of pixels per unit area in the first optical area OA1.

In each of FIGS. 1A to 1C, the first optical area OA1 may have various shapes, such as a circle, an ellipse, a quadrangle, a hexagon, an octagon or the like. In each of FIGS. 1B to 1C, the second optical area OA2 may have various shapes, such as a circle, an ellipse, a quadrangle, a hexagon, an octagon or the like. The first optical area OA1 and the second optical area OA2 may have the same shape or different shapes.

Referring to FIG. 1C, in an example where the first optical area OA1 and the second optical area OA2 contact each other, the entire optical area including the first optical area OA1 and the second optical area OA2 may also have various shapes, such as a circle, an ellipse, a quadrangle, a hexagon, an octagon or the like.

Hereinafter, for convenience of description, discussions will be provided based on an embodiment in which each of the first optical area OA1 and the second optical area OA2 has a circular shape.

Herein, in the example where the display device 100 according to embodiments of the present disclosure has a structure in which the first optical electronic device 11 located to be covered under, or in the lower portion of, the display panel 100 without being exposed to the outside is a camera, the display device 100 may be referred to as a display (or display device) to which under-display camera (UDC) technology is implemented.

The display device 100 according to this configuration can have an advantage of preventing the size of the display area DA from being reduced since a notch or a camera hole for exposing a camera need not be formed in the display panel 110.

Since the notch or the camera hole for camera exposure need not be formed in the display panel 110, the display device 100 can have further advantages of reducing the size of the bezel area, and improving the degree of freedom in design as such limitations to the design are removed.

Although the one or more optical electronic devices (11, 12) are covered on the back of (under, or in the lower portion of) the display panel 110 in the display device 100 according to embodiments of the present disclosure, that is, hidden not to be exposed to the outside, the one or more optical electronic devices (11, 12) are needed to receive or detect light for normally performing predefined functionality.

Further, in the display device 100 according to embodiments of the present disclosure, although the one or more optical electronic devices (11, 12) are covered on the back of (under, or in the lower portion of) the display panel 110 and located to overlap the display area DA, it is necessary for image display to be normally performed in the one or more optical areas (OA1, OA2) overlapping the one or more optical electronic devices (11, 12) in the area DA.

Figure 2:
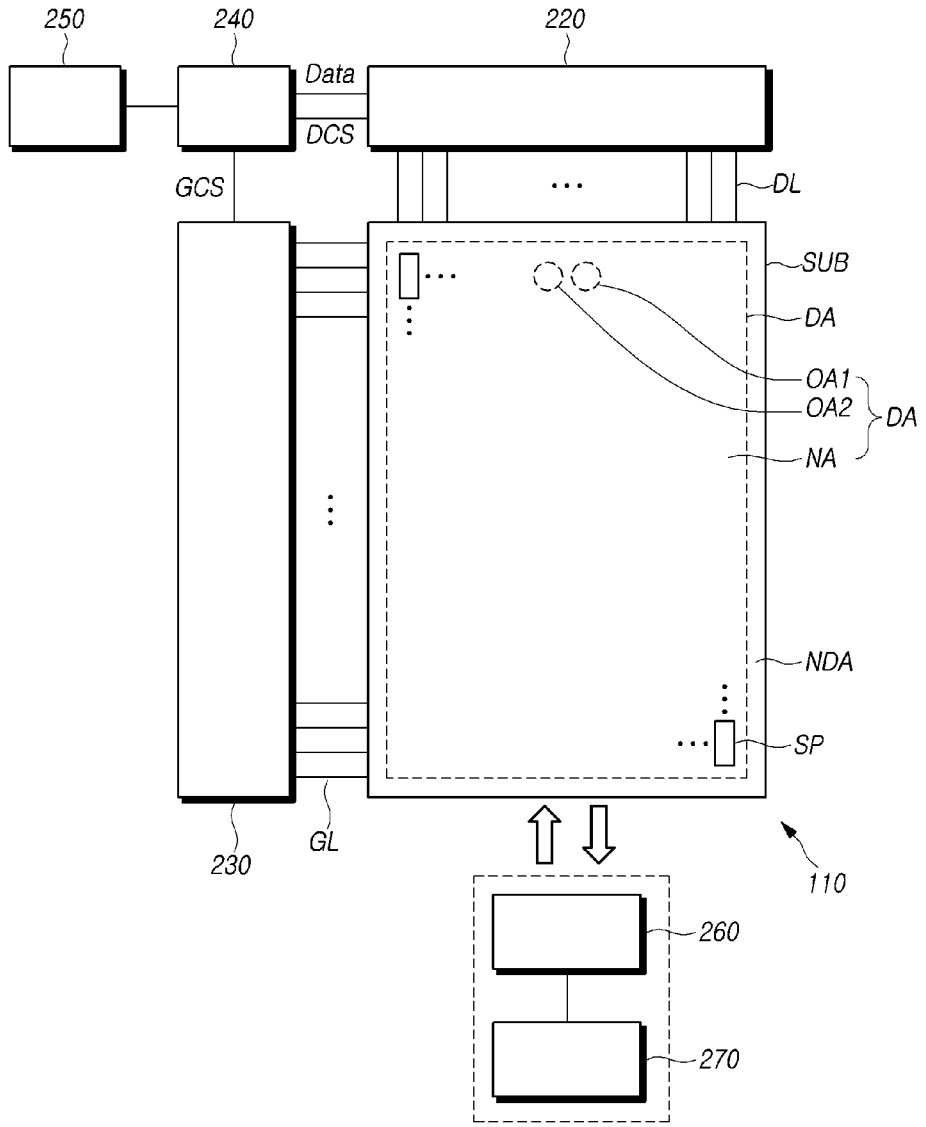
FIG. 2 illustrates a system configuration of the display device according to embodiments of the present disclosure.

FIG. 2 illustrates a system configuration of a display device 100 according to embodiments of the present disclosure.

Referring to FIG. 2, the display device 100 can include the display panel 110 and a display driving circuit as components for displaying an image.

The display driving circuit is a circuit for driving the display panel 110, and can include a data driving circuit 220, a gate driving circuit 230, a display controller 240, and the like.

The display panel 110 can include a display area DA in which an image is displayed and a non-display area NDA in which an image is not displayed. The non-display area NDA may be an area outside of the display area DA, and may also be referred to as an edge area or a bezel area. All or a portion of the non-display area NDA may be an area visible from the front surface of the display device 100, or an area that is bent and invisible from the front surface of the display device 100.

The display panel 110 can include a substrate SUB and a plurality of pixels SP disposed on the substrate SUB. The display panel 110 can further include various types of signal lines to drive the plurality of pixels SP.

In some embodiments, the display device 100 herein may be a liquid crystal display device, or the like, or a self-emission display device in which light is emitted from the display panel 110 itself. In the example where the display device 100 according to aspects of the present disclosure is the self-emission display device, each of the plurality of pixels SP may include a light emitting element.

In some embodiments, the display device 100 may be an organic light emitting display device in which the light emitting element is implemented using an organic light emitting diode (OLED). In some embodiments, the display device 100 may be an inorganic light emitting display device in which the light emitting element is implemented using an inorganic material-based light emitting diode. In some embodiments, the display device 100 may be a quantum dot display device in which the light emitting element is implemented using quantum dots, which are self-emission semiconductor crystals.

The structure of each of the plurality of pixels SP may vary according to types of the display devices 100. In the example where the display device 100 is a self-emission display device including self-emission pixels SP, each pixel SP may include a self-emission light emitting element, one or more transistors, and one or more capacitors.

The various types of signal lines arranged in the display device 100 may include, for example, a plurality of data lines DL for carrying data signals (also referred to as data voltages or image signals), a plurality of gate lines GL for carrying gate signals (also referred to as scan signals), and the like.

The plurality of data lines DL and the plurality of gate lines GL may intersect each other. Each of the plurality of data lines DL may extend in a first direction. Each of the plurality of gate lines GL may extend in a second direction.

For example, the first direction may be a column or vertical direction, and the second direction may be a row or horizontal direction. In another example, the first direction may be the row direction, and the second direction may be the column direction.

The data driving circuit 220 is a circuit for driving the plurality of data lines DL, and can supply data signals to the plurality of data lines DL. The gate driving circuit 230 is a circuit for driving the plurality of gate lines GL, and can supply gate signals to the plurality of gate lines GL.

The display controller 240 is a device for controlling the data driving circuit 220 and the gate driving circuit 230, and can control driving timing for the plurality of data lines DL and driving timing for the plurality of gate lines GL.

The display controller 240 can supply a data driving control signal DCS to the data driving circuit 220 to control the data driving circuit 220, and supply a gate driving control signal GCS to the gate driving circuit 230 to control the gate driving circuit 230.

The display controller 240 can receive input image data from a host system 250 and supply image data Data to the data driving circuit 220 based on the input image data.

The data driving circuit 220 can supply data signals to the plurality of data lines DL according to the driving timing control of the display controller 240.

The data driving circuit 220 can receive the digital image data Data from the display controller 240, convert the received image data Data into analog data signals, and supply the resulting analog data signals to the plurality of data lines DL.

The gate driving circuit 230 can supply gate signals to the plurality of gate lines GL according to the timing control of the display controller 240. The gate driving circuit 230 can receive a first gate voltage corresponding to a turn-on level voltage and a second gate voltage corresponding to a turn-off level voltage along with various gate driving control signals GCS, generate gate signals, and supply the generated gate signals to the plurality of gate lines GL.

In some embodiments, the data driving circuit 220 may be connected to the display panel 110 in a tape automated bonding (TAB) type, or connected to a conductive pad such as a bonding pad of the display panel 110 in a chip on glass (COG) type or a chip on panel (COP) type, or connected to the display panel 110 in a chip on film (COF) type.

In some embodiments, the gate driving circuit 230 may be connected to the display panel 110 in the tape automated bonding (TAB) type, or connected to a conductive pad such as a bonding pad of the display panel 110 in the chip on glass (COG) type or the chip on panel (COP) type, or connected to the display panel 110 in the chip on film (COF) type. In another embodiment, the gate driving circuit 230 may be disposed in the non-display area NDA of the display panel 110 in a gate in panel (GIP) type. The gate driving circuit 230 may be disposed on or over the substrate, or connected to the substrate. That is, in the case of the GIP type, the gate driving circuit 230 may be disposed in the non-display area NDA of the substrate. The gate driving circuit 230 may be connected to the substrate in the case of the chip on glass (COG) type, the chip on film (COF) type, or the like.

At least one of the data driving circuit 220 and the gate driving circuit 230 may be disposed in the display area DA of the display panel 110. For example, at least one of the data driving circuit 220 and the gate driving circuit 230 may be disposed not to overlap pixels SP, or disposed to be overlapped with one or more, or all, of the pixels SP.

The data driving circuit 220 may also be located on, but not limited to, only one side or portion (e.g., an upper edge or a lower edge) of the display panel 110. In some embodiments, the data driving circuit 220 may be located in, but not limited to, two sides or portions (e.g., an upper edge and a lower edge) of the display panel 110 or at least two of four sides or portions (e.g., the upper edge, the lower edge, a left edge, and a right edge) of the display panel 110 according to driving schemes, panel design schemes, or the like.

The gate driving circuit 230 may be located in only one side or portion (e.g., a left edge or a right edge) of the display panel 110. In some embodiments, the gate driving circuit 230 may be connected to two sides or portions (e.g., a left edge and a right edge) of the panel 110, or be connected to at least two of four sides or portions (e.g., an upper edge, a lower edge, the left edge, and the right edge) of the panel 110 according to driving schemes, panel design schemes, or the like.

The display controller 240 may be implemented in a separate component from the data driving circuit 220, or integrated with the data driving circuit 220 and thus implemented in an integrated circuit.

The display controller 240 may be a timing controller used in a typical display technology or a controller or a control device capable of additionally performing other control functions in addition to the function of the typical timing controller. In some embodiments, the display controller 140 may be a controller or a control device different from the timing controller, or a circuitry or a component included in the controller or the control device. The display controller 240 may be implemented with various circuits or electronic components such as an integrated circuit (IC), a field programmable gate array (FPGA), an application specific integrated circuit (ASIC), a processor, and/or the like.

The display controller 240 may be mounted on a printed circuit board, a flexible printed circuit, and/or the like and be electrically connected to the gate driving circuit 220 and the data driving circuit 230 through the printed circuit board, flexible printed circuit, and/or the like.

The display controller 240 may transmit signals to, and receive signals from, the data driving circuit 220 via one or more predefined interfaces. In some embodiments, such interfaces may include a low voltage differential signaling (LVDS) interface, an EPI interface, a serial peripheral interface (SPI), and the like.

In some embodiments, in order to further provide a touch sensing function, as well as an image display function, the display device 100 may include at least one touch sensor, and a touch sensing circuit capable of detecting whether a touch event occurs by a touch object such as a finger, a pen, or the like, or of detecting a corresponding touch position, by sensing the touch sensor.

The touch sensing circuit can include a touch driving circuit 260 capable of generating and providing touch sensing data by driving and sensing the touch sensor, a touch controller 270 capable of detecting the occurrence of a touch event or detecting a touch position using the touch sensing data, and the like.

The touch sensor can include a plurality of touch electrodes. The touch sensor can further include a plurality of touch lines for electrically connecting the plurality of touch electrodes to the touch driving circuit 260.

The touch sensor may be implemented in a touch panel, or in the form of a touch panel, outside of the display panel 110, or be implemented inside of the display panel 110. In the example where the touch sensor is implemented in the touch panel, or in the form of the touch panel, outside of the display panel 110, such a touch sensor is referred to as an add-on type. In the example where the add-on type of touch sensor is disposed, the touch panel and the display panel 110 may be separately manufactured and coupled during an assembly process. The add-on type of touch panel may include a touch panel substrate and a plurality of touch electrodes on the touch panel substrate.

In the example where the touch sensor is implemented inside of the display panel 110, the touch sensor may be disposed over the substrate SUB together with signal lines and electrodes related to display driving during the process of manufacturing the display panel 110.

The touch driving circuit 260 can supply a touch driving signal to at least one of the plurality of touch electrodes, and sense at least one of the plurality of touch electrodes to generate touch sensing data.

The touch sensing circuit can perform touch sensing using a self-capacitance sensing method or a mutual-capacitance sensing method.

In the example where the touch sensing circuit performs touch sensing in the self-capacitance sensing method, the touch sensing circuit can perform touch sensing based on capacitance between each touch electrode and a touch object (e.g., a finger, a pen, etc.).

According to the self-capacitance sensing method, each of the plurality of touch electrodes can serve as both a driving touch electrode and a sensing touch electrode. The touch driving circuit 260 can drive all, or one or more, of the plurality of touch electrodes and sense al, or one or more, of the plurality of touch electrodes.

In the example where the touch sensing circuit performs touch sensing in the mutual-capacitance sensing method, the touch sensing circuit can perform touch sensing based on capacitance between touch electrodes.

According to the mutual-capacitance sensing method, the plurality of touch electrodes are divided into driving touch electrodes and sensing touch electrodes. The touch driving circuit 260 can drive the driving touch electrodes and sense the sensing touch electrodes.

The touch driving circuit 260 and the touch controller 270 included in the touch sensing circuit may be implemented in separate devices or in a single device. Further, the touch driving circuit 260 and the data driving circuit 220 may be implemented in separate devices or in a single device.

The display device 100 may further include a power supply circuit for supplying various types of power to the display driving circuit and/or the touch sensing circuit.

In some embodiments, the display device 100 may be a mobile terminal such as a smart phone, a tablet, or the like, or a monitor, a television (TV), or the like. Such devices may be of various types, sizes, and shapes. The display device 100 according to embodiments of the present disclosure are not limited thereto, and includes displays of various types, sizes, and shapes for displaying information or images.

As described above, the display area DA of the display panel 110 may include a normal area NA and one or more optical areas (OA1, OA2), for example, as shown in FIGS. 1A to 1C.

The normal area NA and the one or more optical areas (OA1, OA2) are areas where an image can be displayed. However, the non-optical NA is an area in which a light transmission structure need not be implemented, and the one or more optical areas OA1, OA2 are areas in which the light transmission structure need be implemented.

As discussed above with respect to the examples of FIGS. 1A to 1C, although the display area DA of the display panel 110 may include the one or more optical areas (OA1, OA2) in addition to the normal area NA, for convenience of description, in the discussion that follows, it is assumed that the display area DA includes first and second optical areas (OA1, OA2) and the normal area NA; and the normal area NA thereof includes the normal areas NAs in FIGS. 1A to 1C, and the first and second optical areas (OA1, OA2) thereof include the first optical areas OA1*s* in FIGS. 1A to 1C and the second optical areas OA2*s* of FIGS. 1B and 1C, respectively, unless explicitly stated otherwise.

Figure 3:
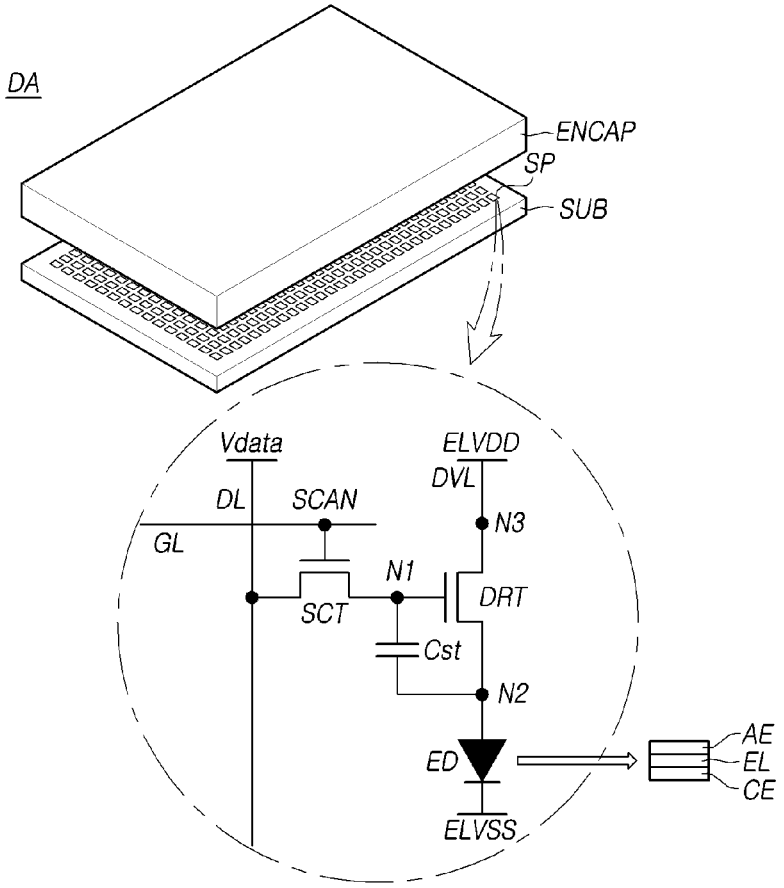
FIG. 3 illustrates an equivalent circuit of a pixel in a display panel according to embodiments of the present disclosure.

FIG. 3 illustrates an equivalent circuit of a pixel SP in the display panel 110 according to embodiments of the present disclosure.

Each of pixels SP disposed in the normal area NA, the first optical area OA1, and the second optical area OA2 included in the display area DA of the display panel 110 may include a light emitting element ED, a driving transistor DRT for driving the light emitting element ED, a scan transistor SCT for transmitting a data voltage VDATA to a first node N1 of the driving transistor DRT, a storage capacitor Cst for maintaining a voltage at an approximate constant level during one frame, and the like.

The driving transistor DRT can include the first node N1 to which a data voltage is applied, a second node N2 electrically connected to the light emitting element ED, and a third node N3 to which a pixel driving voltage ELVDD through a driving voltage line DVL is applied. In the driving transistor DRT, the first node N1 may be a gate node, the second node N2 may be a source node or a drain node, and the third node N3 may be the drain node or the source node.

The light emitting element ED can include an anode electrode AE, an emission layer EL, and a cathode electrode CE. The anode electrode AE may be a pixel electrode disposed in each pixel SP, and may be electrically connected to the second node N2 of the driving transistor DRT of each pixel SP. The cathode electrode CE may be a common electrode commonly disposed in the plurality of pixels SP, and a base voltage ELVSS such as a low-level voltage may be applied to the cathode electrode CE.

For example, the anode electrode AE may be the pixel electrode, and the cathode electrode CE may be the common electrode. In another example, the anode electrode AE may be the common electrode, and the cathode electrode CE may be the pixel electrode. For convenience of description, in the discussion that follows, it is assumed that the anode electrode AE is the pixel electrode, and the cathode electrode CE is the common electrode unless explicitly stated otherwise.

The light emitting element ED may be, for example, an organic light emitting diode (OLED), an inorganic light emitting diode, a quantum dot light emitting element, or the like. In the example where an organic light emitting diode is used as the light emitting element ED, the emission layer EL included in the light emitting element ED may include an organic emission layer including an organic material.

The scan transistor SCT may be turned on and off by a scan signal SCAN that is a gate signal applied through a gate line GL, and be electrically connected between the first node N1 of the driving transistor DRT and a data line DL.

The storage capacitor Cst may be electrically connected between the first node N1 and the second node N2 of the driving transistor DRT.

Each pixel SP may include two transistors (2T: DRT and SCT) and one capacitor (1C: Cst) (referred to as a "2T1C structure") as shown in FIG. 3, and in some cases, may further include one or more transistors, or further include one or more capacitors.

The storage capacitor Cst may be an external capacitor intentionally designed to be located outside of the driving transistor DRT, other than internal capacitors, such as parasitic capacitors (e.g., a Cgs, a Cgd), that may be present between the first node N1 and the second node N2 of the driving transistor DRT.

Each of the driving transistor DRT and the scan transistor SCT may be an n-type transistor or a p-type transistor.

Since circuit elements (in particular, a light emitting element ED) in each pixel SP are vulnerable to external moisture or oxygen, an encapsulation layer ENCAP may be disposed in the display panel 110 in order to prevent the external moisture or oxygen from penetrating into the circuit elements (in particular, the light emitting element ED). The encapsulation layer ENCAP may be disposed to cover the light emitting element ED.

Figure 4:
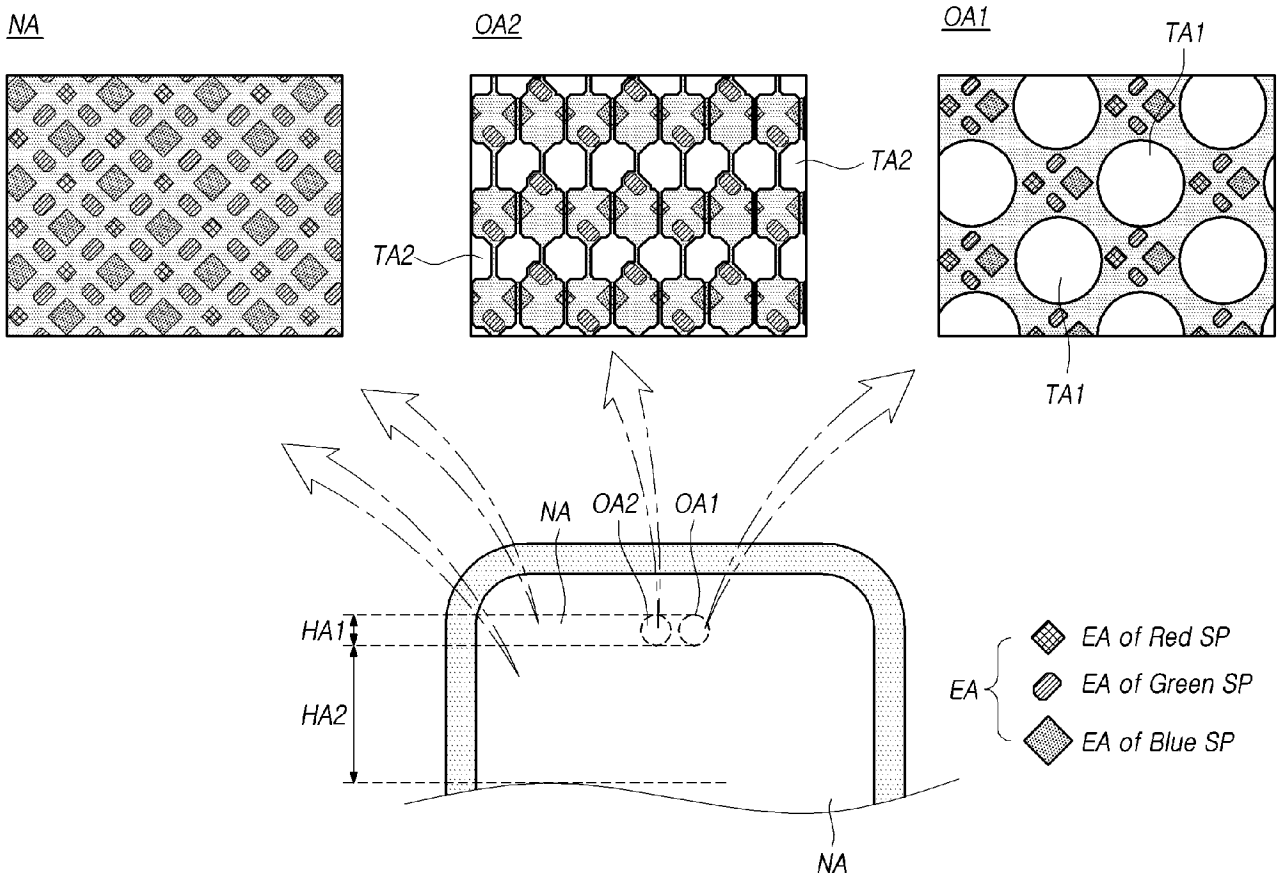
FIG. 4 illustrates arrangements of pixels in three areas included in a display area of the display panel according to embodiments of the present disclosure.

FIG. 4 illustrates arrangements of pixels SP in the three areas (NA, OA1, and OA2) included in the display area DA of the display panel 110 according to embodiments of the present disclosure.

Referring to FIG. 4, a plurality of pixels SP may be disposed in each of the normal area NA, the first optical area OA1, and the second optical area OA2 included in the display area DA.

The plurality of pixels SP may include, for example, a red pixel (Red SP) emitting red light, a green pixel (Green SP) emitting green light, and a blue pixel (Blue SP) emitting blue light.

Accordingly, each of the normal area NA, the first optical area OA1, and the second optical area OA2 may include one or more light emitting areas EA of one or more red pixels (Red SP), and one or more light emitting areas EA of one or more green pixels (Green SP), and one or more light emitting areas EA of one or more blue pixels (Blue SP).

Referring to FIG. 4, the normal area NA may not include a light transmission structure, but may include light emitting areas EA without the light transmission structure.

However, the first optical area OA1 and the second optical area OA2 include both the light emitting areas EA and the light transmission structure.

Accordingly, the first optical area OA1 can include light emitting areas EA and first transmission areas TA1 (e.g., light transmission areas), and the second optical area OA2 can include the light emitting areas EA and second transmission area TA2 (e.g., light transmission areas).

The light emitting areas EA and the transmission areas (TA1, TA2) may be distinct according to whether the transmission of light is allowed. For example, the light emitting areas EA may be areas not allowing light to transmit, and the transmission areas TA1, TA2 may be areas allowing light to transmit.

The light emitting areas EA and the transmission areas TA1, TA2 may be also distinct according to whether or not a specific metal layer CE is included. For example, the cathode electrode CE may be disposed in the light emitting areas EA, and the cathode electrode CE may not be disposed in the transmission areas (TA1, TA2). Further, a light shield layer may be disposed in the light emitting areas EA, and a light shield layer may not be disposed in the transmission areas (TA1, TA2).

Since the first optical area OA1 includes the first transmission areas TA1 and the second optical area OA2 includes the second transmission areas TA2, both of the first optical area OA1 and the second optical area OA2 are areas through which light can pass.

In one embodiment, a transmittance (a degree of transmission) of the first optical area OA1 and a transmittance (a degree of transmission) of the second optical area OA2 may be substantially equal.

For example, the first transmission area TA1 of the first optical area OA1 and the second transmission area TA2 of the second optical area OA2 may have a substantially equal shape or size. In another example, even when the first transmission area TA1 of the first optical area OA1 and the second transmission area TA2 of the second optical area OA2 have different shapes or sizes, a ratio of the first transmission area TA1 to the first optical area OA1 and a ratio of the second transmission area TA2 to the second optical area OA2 may be substantially equal.

In another embodiment, a transmittance (a degree of transmission) of the first optical area OA1 and a transmittance (a degree of transmission) of the second optical area OA2 may be different.

For example, the first transmission area TA1 of the first optical area OA1 and the second transmission area TA2 of the second optical area OA2 may have different shapes or sizes. In another example, even when the first transmission area TA1 of the first optical area OA1 and the second transmission area TA2 of the second optical area OA2 have a substantially equal shape or size, a ratio of the first transmission area TA1 to the first optical area OA1 and a ratio of the second transmission area TA2 to the second optical area OA2 may be different from each other.

For example, in the example where the first optical electronic device 11 overlapping the first optical area OA1 is a camera, and the second optical electronic device 12 overlapping the second optical area OA2 is a sensor for detecting images, the camera may need a greater amount of light than the sensor.

Thus, the transmittance (degree of transmission) of the first optical area OA1 may be greater than the transmittance (degree of transmission) of the second optical area OA2.

For example, the first transmission area TA1 of the first optical area OA1 may have a size greater than the second transmission area TA2 of the second optical area OA2. In another example, even when the first transmission area TA1 of the first optical area OA1 and the second transmission area TA2 of the second optical area OA2 have a substantially equal size, a ratio of the first transmission area TA1 to the first optical area OA1 may be greater than a ratio of the second transmission area TA2 to the second optical area OA2.

For convenience of description, the discussion that follows is performed based on the embodiment in which the transmittance (degree of transmission) of the first optical area OA1 is greater than the transmittance (degree of transmission) of the second optical area OA2.

Further, the transmission areas (TA1, TA2) as shown in FIG. 4 may be referred to as transparent areas, and the term transmittance may be referred to as transparency.

Further, in the discussion that follows, it is assumed that the first optical areas OA1 and the second optical areas OA2 are located in an upper edge of the display area DA of the display panel 110, and are disposed to be horizontally adjacent to each other such as being disposed in a direction in which the upper edge extends, as shown in FIG. 4, unless explicitly stated otherwise.

Referring to FIG. 4, a horizontal display area in which the first optical area OA1 and the second optical area OA2 are disposed is referred to as a first horizontal display area HA1, and another horizontal display area in which the first optical area OA1 and the second optical area OA2 are not disposed is referred to as a second horizontal display area HA2.

Referring to FIG. 4, the first horizontal display area HA1 may include a portion of the normal area NA, the first optical area OA1, and the second optical area OA2. The second horizontal display area HA2 may include another portion of the normal area NA that lacks the first optical area OA1 and the second optical area OA2.

Figure 5A:
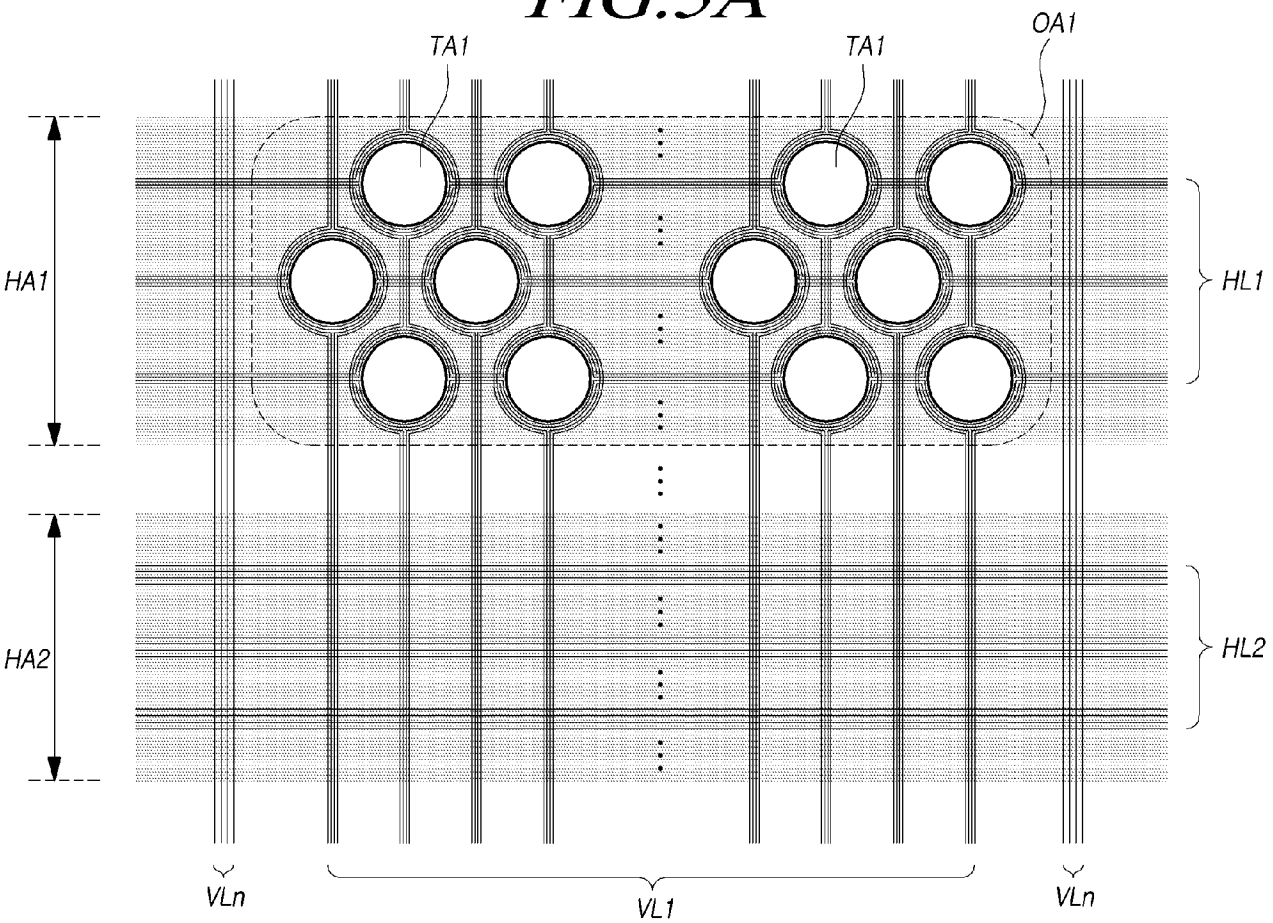
FIG. 5A illustrates arrangements of signal lines in each of a first optical area and a normal area in the display panel according to embodiments of the present disclosure.
Figure 5B:
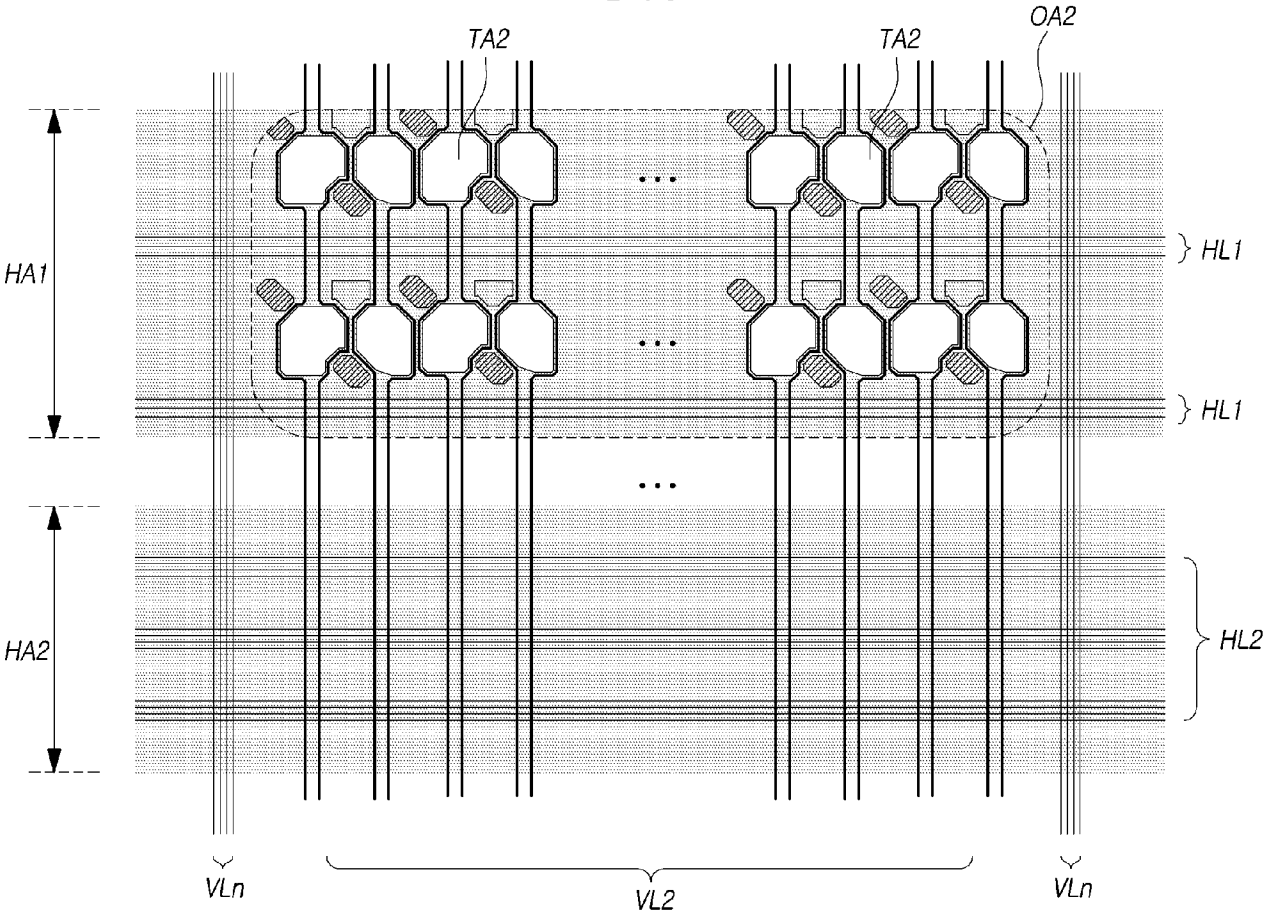
FIG. 5B illustrates arrangements of signal lines in each of a second optical area and the normal area in the display panel according to embodiments of the present disclosure.

FIG. 5A illustrates arrangements of signal lines in each of the first optical area OA1 and the normal area NA of the display panel 110 according to embodiments of the present disclosure, and FIG. 5B illustrates arrangements of signal lines in each of the second optical area OA2 and the normal area NA of the display panel 110 according to embodiments of the present disclosure.

First horizontal display areas HA1 shown in FIGS. 5A and 5B are portions of the first horizontal display area HA1 of the display panel 110, and second horizontal display areas HA2 therein are portions of the second horizontal display area HA2 of the display panel 110.

A first optical area OA1 shown in FIG. 5A is a portion of the first optical area OA1 of the display panel 110, and a second optical area OA2 shown in FIG. 5B is a portion of the second optical area OA2 of the display panel 110.

Referring to FIGS. 5A and 5B, the first horizontal display area HA1 may include a portion of the normal area NA, the first optical area OA1, and the second optical area OA2. The second horizontal display area HA2 may include another portion of the normal area NA that lacks the first optical area OA1 and the second optical area OA2.

Various types of horizontal lines HL1, HL2 and various types of vertical lines VLn, VL1, VL2 may be disposed in the display panel 11.

Herein, the term "horizontal" and the term "vertical" are used to refer to two directions intersecting the display panel. However, it should be noted that the horizontal direction and the vertical direction may be changed depending on a viewing direction. The horizontal direction may refer to, for example, a direction in which one gate line GL extends and, and the vertical direction may refer to, for example, a direction in which one data line DL extends. As such, the term horizontal and the term vertical are used to represent two directions.

Referring to FIGS. 5A and 5B, the horizontal lines disposed in the display panel 110 may include first horizontal lines HL1 disposed in the first horizontal display area HA1 and second horizontal lines HL2 disposed on the second horizontal display area HA2.

The horizontal lines disposed in the display panel 110 may be gate lines GL. That is, the first horizontal lines HL1 and the second horizontal lines HL2 may be the gate lines GL. The gate lines GL may include various types of gate lines according to structures of one or more pixels SP.

Referring to FIGS. 5A and 5B, the vertical lines disposed in the display panel 110 may include typical vertical lines VLn disposed only in the normal area NA, first vertical lines VL1 running through both of the first optical area OA1 and the normal area NA, second vertical lines VL2 running through both of the second optical area OA2 and the normal area NA.

The vertical lines disposed in the display panel 110 may include data lines DL, driving voltage lines DVL, and the like, and may further include reference voltage lines, initialization voltage lines, and the like. That is, the typical vertical lines VLn, the first vertical lines VL1 and the second vertical lines VL2 may include the data lines DL, the driving voltage lines DVL, and the like, and may further include the reference voltage lines, the initialization voltage lines, and the like.

In some embodiments, it should be noted that the term "horizontal" in the second horizontal line HL2 may mean only that a signal is carried from a left side, to a right side, of the display panel (or from the right side to the left side), and may not mean that the second horizontal line HL2 runs in a straight line only in the direct horizontal direction. For example, in FIGS. 5A and 5B, although the second horizontal lines HL2 are illustrated in a straight line, however, one or more of the second horizontal lines HL2 may include one or more bent or folded portions differently from the configurations thereof. Likewise, one or more of the first horizontal lines HL1 may also include one or more bent or folded portions.

In some embodiments, it should be noted that the term "vertical" in the typical vertical line VLn may mean only that a signal is carried from an upper portion, to a lower portion, of the display panel (or from the lower portion to the upper portion), and may not mean that the typical vertical line VLn runs in a straight line only in the direct vertical direction. For example, in FIGS. 5A and 5B, although the typical vertical lines VLn are illustrated in a straight line, however, one or more of the typical vertical lines VLn may include one or more bent or folded portions differently from the configurations thereof. Likewise, one or more of the first vertical line VL1 and one or more of the second vertical line VL2 may also include one or more bent or folded portions.

Referring to FIG. 5A, the first optical area OA1 included in the first horizontal area HA1 may include light emitting areas EA and first transmission areas TA1. In the first optical area OA1, respective outer areas of the first transmission areas TA1 may include corresponding light emitting areas EA.

Referring to FIG. 5A, in order to improve the transmittance of the first optical area OA1, the first horizontal lines HL1 may run through the first optical area OA1 while avoiding the first transmission areas TA1 in the first optical area OA1.

Accordingly, each of the first horizontal lines HL1 running through the first optical area OA1 may include one or more curved or bent portions running around one or more respective outer edges of one or more of the first transmission areas TA1.

Accordingly, the first horizontal lines HL1 disposed in the first horizontal area HA1 and the second horizontal lines HL2 disposed in the second horizontal area HA2 may have different shapes or lengths. For example, the first horizontal lines HL1 running through the first optical area OA1 and the second horizontal lines HL2 not running through the first optical area OA1 may have different shapes or lengths.

Further, in order to improve the transmittance of the first optical area OA1, the first vertical lines VL1 may run through the first optical area OA1 while avoiding the first transmission areas TA1 in the first optical area OA1.

Accordingly, each of the first vertical lines VL1 running through the first optical area OA1 may include one or more curved or bent portions running around one or more respective outer edges of one or more of the first transmission areas TA1.

Thus, the first vertical lines VL1 running through the first optical area OA1 and the typical vertical lines VLn disposed in the normal area NA without running through the first optical area OA1 may have different shapes or lengths.

Referring to FIG. 5A, the first transmission areas TA1 included in the first optical area OA1 in the first horizontal area HA1 may be arranged in a diagonal direction.

Referring to FIG. 5A, in the first optical area OA1 in the first horizontal area HA1, one or more light emitting areas EA may be disposed between two horizontally adjacent first transmission areas TA1. In the first optical area OA1 in the first horizontal area HA1, one or more light emitting areas EA may be disposed between two vertically adjacent first transmission areas TA1.

Referring to FIG. 5A, the first horizontal lines HL1 disposed in the first horizontal area HA1, that is, the first horizontal lines HL1 running through the first optical area OA1 each may include one or more curved or bent portions running around one or more respective outer edges of one or more of the first transmission areas TA1.

Referring to FIG. 5B, the second optical area OA2 included in the first horizontal area HA1 may include light emitting areas EA and second transmission areas TA2. In the second optical area OA2, respective outer areas of the second transmission areas TA2 may include corresponding light emitting areas EA.

In one embodiment, the light emitting areas EA and the second transmission areas TA2 in the second optical area OA2 may have locations and arrangements substantially equal to the light emitting areas EA and the first transmission areas TA1 in the first optical area OA1 of FIG. 5A.

In another embodiment, as shown in FIG. 5B, the light emitting areas EA and the second transmission areas TA2 in the second optical area OA2 may have locations and arrangements different from the light emitting areas EA and the first transmission areas TA1 in the first optical area OA1 of FIG. 5A.

For example, referring to FIG. 5B, the second transmission areas TA2 in the second optical area OA2 may be arranged in the horizontal direction (the left to right or right to left direction). A light emitting area EA may not be disposed between two second transmission areas TA2 adjacent to each other in the horizontal direction. Further, one or more of the light emitting areas EA in the second optical area OA2 may be disposed between second transmission areas TA2 adjacent to each other in the vertical direction (the top to bottom or bottom to top direction). For example, one or more light emitting areas EA may be disposed between two rows of second transmission areas.

When in the first horizontal area HA1, running through the second optical area OA2 and the normal area NA adjacent to the second optical area OA2, in one embodiment, the first horizontal lines HL1 may have substantially the same arrangement as the first horizontal lines HL1 of FIG. 5A.

In another embodiment, as shown in FIG. 5B, when in the first horizontal area HA1, running through the second optical area OA2 and the normal area NA adjacent to the second optical area OA2, the first horizontal lines HL1 may have an arrangement different from the first horizontal lines HL1 of FIG. 5A.

This is because that the light emitting areas EA and the second transmission areas TA2 in the second optical area OA2 of FIG. 5B have locations and arrangements different from the light emitting areas EA and the first transmission areas TA1 in the first optical area OA1 of FIG. 5A.

Referring to FIG. 5B, when in the first horizontal area HA1, the first horizontal lines HL1 run through the second optical area OA2 and the normal area NA adjacent to the second optical area OA2, the first horizontal lines HL1 may run between vertically adjacent second transmission areas TA2 in a straight line without having a curved or bent portion.

For example, one first horizontal line HL1 may have one or more curved or bent portions in the first optical area OA1, but may not have a curved or bent portion in the second optical area OA2.

In order to improve the transmittance of the second optical area OA2, the second vertical lines VL2 may run through the second optical area OA2 while avoiding the second transmission areas TA2 in the second optical area OA2.

Accordingly, each of the second vertical lines VL2 running through the second optical area OA2 may include one or more curved or bent portions running around one or more respective outer edges of one or more of the second transmission areas TA2.

Thus, the second vertical lines VL2 running through the second optical area OA2 and the typical vertical lines VLn disposed in the normal area NA without running through the second optical area OA2 may have different shapes or lengths.

As shown in FIG. 5A, each, or one or more, of the first horizontal lines HL1 running through the first optical area OA1 may have one or more curved or bent portions running around one or more respective outer edges of one or more of the first transmission areas TA1.

Accordingly, a length of the first horizontal line HL1 running through the first optical area OA1 and the second optical area OA2 may be slightly longer than a length of the second horizontal line HL2 disposed in the normal area NA without running through the first optical area OA1 and the second optical area OA2 and.

Accordingly, a resistance of the first horizontal line HL1 running through the first optical area OA1 and the second optical area OA2, which is referred to as a first resistance, may be slightly greater than a resistance of the second horizontal line HL2 disposed in the normal area NA without running through the first optical area OA1 and the second optical area OA2 and, which is referred to as a second resistance.

Referring to FIGS. 5A and 5B, according to a light transmitting structure, since the first optical area OA1 that at least partially overlaps the first optical electronic device 11 includes the first transmission areas TA1, and the second optical area OA2 that at least partially overlaps with the second optical electronic device 12 includes the second transmission areas TA2, therefore, the first optical area OA1 and the second optical area OA2 may have the number of pixels per unit area less than the normal area NA.

Accordingly, the number of pixels connected to each, or one or more, of the first horizontal lines HL1 running through the first optical area OA1 and the second optical area OA2 may be different from the number of pixels connected to each, or one or more, of the second horizontal lines HL2 disposed only in the normal area NA without running through the first optical area OA1 and the second optical area OA2.

The number of pixels connected to each, or one or more, of the first horizontal lines HL1 running through the first optical area OA1 and the second optical area OA2, which is referred to as a first number, may be less than the number of pixels connected to each, or one or more, of the second horizontal lines HL2 disposed only in the normal area NA without running through the first optical area OA1 and the second optical area OA2, which is referred to as a second number.

A difference between the first number and the second number may vary according to a difference between a resolution of each of the first optical area OA1 and the second optical area OA2 and a resolution of the normal area NA. For example, as a difference between a resolution of each of the first optical area OA1 and the second optical area OA2 and a resolution of the normal area NA increases, a difference between the first number and the second number may increase.

As described above, since the number (the first number) of pixels connected to each, or one or more, of the first horizontal lines HL1 running through the first optical area OA1 and the second optical area OA2 is less than the number of pixels (second number) connected to each, or one or more, of the second horizontal lines HL2 disposed only in the normal area NA without running through the first optical area OA1 and the second optical area OA2, an area where the first horizontal line HL1 overlaps one or more other electrodes or lines adjacent to the first horizontal line HL1 may be smaller than an area where the second horizontal line HL2 overlaps one or more other electrodes or lines adjacent to the second horizontal line HL2.

Accordingly, a parasitic capacitance formed between the first horizontal line HL1 and one or more other electrodes or lines adjacent to the first horizontal line HL1, which is referred to as a first capacitance, may be greatly less than a parasitic capacitance formed between the second horizontal line HL2 and one or more other electrodes or lines adjacent to the second horizontal line HL2, which is referred to as a second capacitance.

Considering a relationship in magnitude between the first resistance and the second resistance (the first resistance≥the second resistance) and a relationship in magnitude between the first capacitance and the second capacitance (the first capacitance<<second capacitance), a resistance-capacitance (RC) value of the first horizontal line HL1 running through the first optical area OA1 and the second optical area OA2, which is referred to as a first RC value, may be greatly less than an RC value of the second horizontal lines HL2 disposed in the normal area NA without running through the first optical area OA1 and the second optical area OA2, which is referred to as a second RC value, that is, resulting in the first RC value<<the second RC value.

Due to such a difference between the first RC value of the first horizontal line HL1 and the second RC value of the second horizontal line HL2, which is referred to as an RC load difference, a signal transmission characteristic through the first horizontal line HL1 may be different from a signal transmission characteristic through the second horizontal line HL2.

Figure 6:
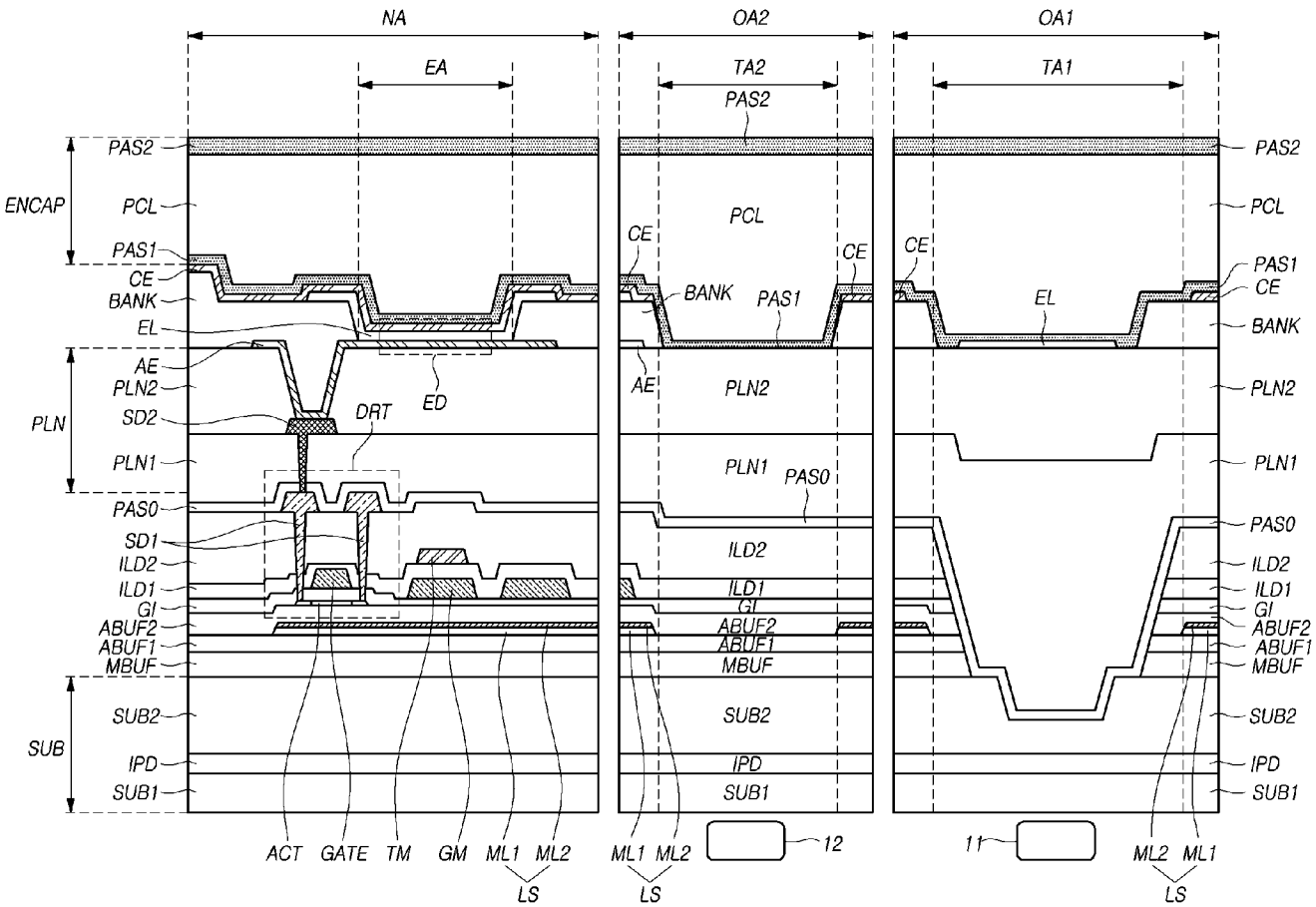
FIGS. 6 and 7 are cross-sectional views of each of the first optical area, the second optical area, and the normal area included in the display area of the display panel according to aspects of the embodiments disclosure.
Figure 7:
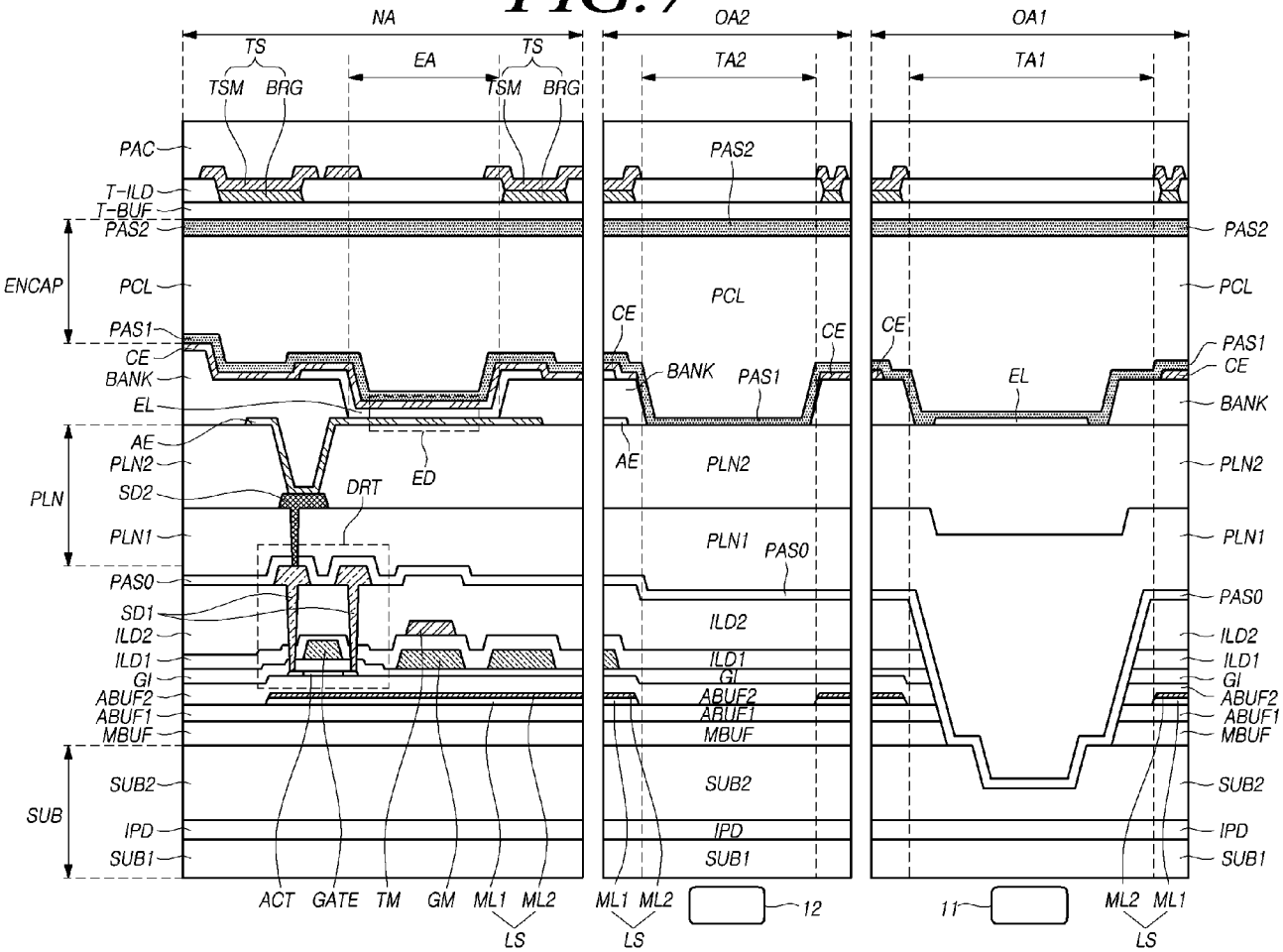

FIGS. 6 and 7 are cross-sectional views of each of the first optical area OA1, the second optical area OA2, and the normal area NA included in the display area DA of the display panel 110 according to embodiments of the present disclosure.

FIG. 6 shows the display panel 110 in an example where a touch sensor is implemented outside of the display panel 110 in the form of a touch panel, and FIG. 7 shows the display panel 110 in an example where a touch sensor TS is implemented inside of the display panel 110.

Each of FIGS. 6 and 7 shows cross-sectional views of the normal area NA, the first optical area OA1, and the second optical area OA2 included in the display area DA.

A stack structure of the normal area NA will be described with reference to FIGS. 6 and 7. Respective light emitting areas EA of the first optical area OA1 and the second optical area OA2 may have the same stack structure as the light emitting area EA of the normal area NA1.

Referring to FIGS. 6 and 7, a substrate SUB may include a first substrate SUB1, an interlayer insulating layer IPD, and a second substrate SUB2. The interlayer insulating layer IPD may be interposed between the first substrate SUB1 and the second substrate SUB2. As the substrate SUB includes the first substrate SUB1, the interlayer insulating layer IPD, and the second substrate SUB2, the substrate SUB can prevent or at least reduce the penetration of moisture. The first substrate SUB1 and the second substrate SUB2 may be, for example, polyimide (PI) substrates. The first substrate SUB1 may be referred to as a primary PI substrate, and the second substrate SUB2 may be referred to as a secondary PI substrate.

Referring to FIGS. 6 and 7, various types of patterns ACT, SD1, GATE, for disposing one or more transistors such as a driving transistor DRT, and the like, various types of insulating layers MBUF, ABUF1, ABUF2, GI, ILD1, ILD2, PAS0, and various types of metal patterns TM, GM, ML1, ML2 may be disposed on or over the substrate SUB.

Referring to FIGS. 6 and 7, a multi-buffer layer MBUF may be disposed on the second substrate SUB2, and a first active buffer layer ABUF1 may be disposed on the multi-buffer layer MBUF.

A first metal layer ML1 and a second metal layer ML2 may be disposed on the first active buffer layer ABUF1. The first metal layer ML1 and the second metal layer ML2 may be, for example, light shield layers LS for shielding light.

A second active buffer layer ABUF2 may be disposed on the first metal layer ML1 and the second metal layer ML2. An active layer ACT of the driving transistor DRT may be disposed on the second active buffer layer ABUF2.

A gate insulating layer GI may be disposed to cover the active layer ACT.

A gate electrode GATE of the driving transistor DRT may be disposed on the gate insulating layer GI. Further, a gate material layer GM may be disposed on the gate insulating layer GI, together with the gate electrode GATE of the driving transistor DRT, at a location different from the location where the driving transistor DRT is disposed.

A first interlayer insulating layer ILD1 may be disposed to cover the gate electrode GATE and the gate material layer GM. A metal pattern TM may be disposed on the first interlayer insulating layer ILD1. The metal pattern TM may be located at a location different from the location where the driving transistor DRT is formatted. A second interlayer insulating layer ILD2 may be disposed to cover the metal pattern TM on the first interlayer insulating layer ILD1.

Two first source-drain electrode patterns SD1 may be disposed on the second interlayer insulating layer ILD2. One of the two first source-drain electrode patterns SD1 may be a source node of the driving transistor DRT, and the other may be a drain node of the driving transistor DRT.

The two first source-drain electrode patterns SD1 may be electrically connected to first and second side portions of the active layer ACT, respectively, through contact holes formed in the second interlayer insulating layer ILD2, the first interlayer insulating layer ILD1, and the gate insulating layer GI.

A portion of the active layer ACT overlapping the gate electrode GATE may serve as a channel region. One of the two first source-drain electrode patterns SD1 may be connected to the first side portion of the channel region of the active layer ACT, and the other of the two first source-drain electrode patterns SD1 may be connected to the second side portion of the channel region of the active layer ACT.

A passivation layer PAS0 may be disposed to cover the two first source-drain electrode patterns SD1. A planarization layer PLN may be disposed on the passivation layer PAS0. The planarization layer PLN may include a first planarization layer PLN1 and a second planarization layer PLN2.

The first planarization layer PLN1 may be disposed on the passivation layer PAS0.

A second source-drain electrode pattern SD2 may be disposed on the first planarization layer PLN1. The second source-drain electrode pattern SD2 may be connected to one of the two first source-drain electrode patterns SD1 (corresponding to the second node N2 of the driving transistor DRT in the pixel SP of FIG. 3) through a contact hole formed in the first planarization layer PLN1.

The second planarization layer PLN2 may be disposed to cover the second source-drain electrode pattern SD2. A light emitting element ED may be disposed on the second planarization layer PLN2.

According to an example stack structure of the light emitting element ED, an anode electrode AE may be disposed on the second planarization layer PLN2. The anode electrode AE may be electrically connected to the second source-drain electrode pattern SD2 through a contact hole formed in the second planarization layer PLN2.

A bank BANK may be disposed to cover a portion of the anode electrode AE. A portion of the bank BANK corresponding to a light emitting area EA of the pixel SP may be opened.

A portion of the anode electrode AE may be exposed through the opening (the opened portion) of the bank BANK. An emission layer EL may be positioned on side surfaces of the bank BANK and in the opening (the opened portion) of the bank BANK. All or at least a portion of the emission layer EL may be located between adjacent banks.

In the opening of the bank BANK, the emission layer EL may contact the anode electrode AE. A cathode electrode CE may be disposed on the emission layer EL.

The light emitting element ED can be formed by including the anode electrode AE, the emission layer EL, and the cathode electrode CE, as described above. The emission layer EL may include an organic material layer.

An encapsulation layer ENCAP may be disposed on the stack of the light emitting element ED.

The encapsulation layer ENCAP may have a single-layer structure or a multi-layer structure for example, as shown in FIGS. 6 and 7, the encapsulation layer ENCAP may include a first encapsulation layer PAS1, a second encapsulation layer PCL, and a third encapsulation layer PAS2.

The first encapsulation layer PAS1 and the third encapsulation layer PAS2 may be, for example, an inorganic material layer, and the second encapsulation layer PCL may be, for example, an organic material layer. Among the first encapsulation layer PAS1, the second encapsulation layer PCL, and the third encapsulation layer PAS2, the second encapsulation layer PCL may be the thickest and serve as a planarization layer.

The first encapsulation layer PAS1 may be disposed on the cathode electrode CE and may be disposed closest to the light emitting element ED. The first encapsulation layer PAS1 may include an inorganic insulating material capable of being deposited using low-temperature deposition. For example, the first encapsulation layer PAS1 may include, but not limited to, silicon nitride (SiNx), silicon oxide (SiOx), silicon oxynitride (SiON), aluminum oxide (Al2O3), or the like. Since the first encapsulation layer PAS1 can be deposited in a low temperature atmosphere, during the deposition process, the first encapsulation layer PAS1 can prevent the emission layer EL including an organic material vulnerable to a high temperature atmosphere from being damaged.

The second encapsulation layer PCL may have a smaller area or size than the first encapsulation layer PAS1. For example, the second encapsulation layer PCL may be disposed to expose both ends or edges of the first encapsulation layer PAS1. The second encapsulation layer PCL can serve as a buffer for relieving stress between corresponding layers while the display device 100 is curved or bent, and also serve to enhance planarization performance. For example, the second encapsulation layer PCL may include an organic insulating material, such as acrylic resin, epoxy resin, polyimide, polyethylene, silicon oxycarbon (SiOC), or the like. The second encapsulation layer PCL may be disposed, for example, using an inkjet scheme.

The third encapsulation layer PAS2 may be disposed over the substrate SUB over which the second encapsulation layer PCL is disposed such that the third inorganic encapsulation layer PAS2 covers the respective top surfaces and side surfaces of the second encapsulation layer PCL and the first encapsulation layer PAS1. The third encapsulation layer PAS2 can minimize or prevent or at least reduce external moisture or oxygen from penetrating into the first encapsulation layer PAS1 and the second encapsulation layer PCL. For example, the third encapsulation layer PAS2 may include an inorganic insulating material, such as silicon nitride (SiNx), silicon oxide (SiOx), silicon oxynitride (SiON), aluminum oxide (Al2O3), or the like.

Referring to FIG. 7, in an example where a touch sensor TS is embedded into the display panel 110, the touch sensor TS may be disposed on the encapsulation layer ENCAP. The structure of the touch sensor will be described in detail as follows.

A touch buffer layer T-BUF may be disposed on the encapsulation layer ENCAP. The touch sensor TS may be disposed on the touch buffer layer T-BUF.

The touch sensor TS may include touch sensor metals TSM and at least one bridge metal BRG, which are located in different layers.

A touch interlayer insulating layer T-ILD may be disposed between the touch sensor metals TSM and the bridge metal BRG.

For example, the touch sensor metals TSM may include a first touch sensor metal TSM, a second touch sensor metal TSM, and a third touch sensor metal TSM, which are disposed adjacent to one another. In an embodiment where the third touch sensor metal TSM is disposed between the first touch sensor metal TSM and the second touch sensor metal TSM, and the first touch sensor metal TSM and the second touch sensor metal TSM need to be electrically connected to each other, the first touch sensor metal TSM and the second touch sensor metal TSM may be electrically connected to each other through the bridge metal BRG located in a different layer. The bridge metal BRG may be electrically insulated from the third touch sensor metal TSM by the touch interlayer insulating layer T-ILD.

While the touch sensor TS is disposed on the display panel 110, a chemical solution (e.g., developer or etchant, etc.) used in the corresponding process or moisture from the outside may be generated or introduced. By disposing the touch sensor TS on the touch buffer layer T-BUF, a chemical solution or moisture can be prevented from penetrating into the emission layer EL including an organic material during the manufacturing process of the touch sensor TS. Accordingly, the touch buffer layer T-BUF can prevent or at least reduce damage to the emission layer EL, which is vulnerable to a chemical solution or moisture.

In order to prevent or at least reduce damage to the emission layer EL including an organic material, which is vulnerable to high temperatures, the touch buffer layer T-BUF can be formed at a low temperature less than or equal to a predetermined temperature (e.g., 100 degrees (° C.)) and be formed using an organic insulating material having a low permittivity of 1 to 3. For example, the touch buffer layer T-BUF may include an acrylic-based, epoxy-based, or silicon-based material. As the display device 100 is bent, the encapsulation layer ENCAP may be damaged, and the touch sensor metal located on the touch buffer layer T-BUF may be cracked or broken. Even when the display device 100 is bent, the touch buffer layer T-BUF having the planarization performance as the organic insulating material can prevent the damage of the encapsulation layer ENCAP and/or the cracking or breaking of the metals (TSM, BRG) included in the touch sensor TS.

A protective layer PAC may be disposed to cover the touch sensor TS. The protective layer PAC may be, for example, an organic insulating layer.

Next, a stack structure of the first optical area OA1 will be described with reference to FIGS. 6 and 7.

Referring to FIGS. 6 and 7, the light emitting area EA of the first optical area OA1 may have the same stack structure as that in the normal area NA. Accordingly, in the discussion that follows, instead of repeatedly describing the light emitting area EA in the first optical area OA1, a stack structure of the first transmission area TA1 in the first optical area OA1 will be described in detail below.

The cathode electrode CE may be disposed in the light emitting areas EA included in the normal area NA and the first optical area OA1, but may not be disposed in the first transmission area TA1 in the first optical area OA1. For example, the first transmission area TA1 in the first optical area OA1 may correspond to an opening of the cathode electrode CE.

Further, a light shield layer LS including at least one of the first metal layer ML1 and the second metal layer ML2 may be disposed in the light emitting areas EA included in the normal area NA and the first optical area OA1, but may not be disposed in the first transmission area TA1 in the first optical area OA1. For example, the first transmission area TA1 in the first optical area OA1 may correspond to an opening of the light shield layer LS.

The substrate SUB, and the various types of insulating layers (MBUF, ABUF1, ABUF2, GI, ILD1, ILD2, PAS0, PLN (PLN1, PLN2), BANK, ENCAP (PAS1, PCL, PAS2), T-BUF, T-ILD, PAC) disposed in the light emitting areas EA included in the normal area NA and the first optical area OA1 may be disposed in the first transmission area TA1 in the first optical area OA1 equally, substantially equally, or similarly.

However, all, or one or more, of one or more material layers having electrical properties (e.g., a metal material layer, a semiconductor layer, etc.), except for the insulating materials or layers, disposed in the light emitting areas EA included in the normal area NA and the first optical area OA1 may not be disposed in the first transmission area TA1 in the first optical area OA1.

For example, referring to FIGS. 6 and 7, all, or one or more, of the metal material layers (ML1, ML2, GATE, GM, TM, SD1, SD2) related to at least one transistor and the semiconductor layer ACT may not be disposed in the first transmission area TA1.

Further, referring to FIGS. 6 and 7, the anode electrode AE and the cathode electrode CE included in the light emitting element ED may not be disposed in the first transmission area TA1. In some embodiments, the emission layer EL of the light emitting element ED may or may not be disposed in the first transmission area TA1 according to a design requirement.

Further, referring to FIG. 7, the touch sensor metal TSM and the bridge metal BRG included in the touch sensor TS may not be disposed in the first transmission area TA1 in the first optical area OA1.

Accordingly, the light transmittance of the first transmission area TA1 in the first optical area OA1 can be provided or improved because the material layers (e.g., the metal material layer, the semiconductor layer, etc.) having electrical properties are not disposed in the first transmission area TA1 in the first optical area OA1. As a consequence, the first optical electronic device 11 can perform a predefined function (e.g., image sensing) by receiving light transmitting through the first transmission area TA1.

Since all, or one or more, of the first transmission area TA1 in the first optical area OA1 overlap the first optical electronic device 11, to enable the first optical electronic device 11 to normally operate, it is desired to further increase a transmittance of the first transmission area TA1 in the first optical area OA1.

To do this, in some embodiments, the first transmission area TA1 formed in the first optical area OA1 of the display panel 110 of the display device 100 can have a transmittance improvement structure TIS.

Referring to FIGS. 6 and 7, the plurality of insulating layers included in the display panel 110 may include at least one buffer layer (MBUF, ABUF1, ABUF2) between at least one substrate (SUB1, SUB2) and at least one transistor (DRT, SCT), at least one planarization layers (PLN1, PLN2) between the transistor DRT and the light emitting element ED, at least one encapsulation layer ENCAP on the light emitting element ED, and the like.

Referring to FIG. 7, the plurality of insulating layers included in the display panel 110 may further include the touch buffer layer T-BUF and the touch interlayer insulating layer T-ILD located on the encapsulation layer ENCAP, and the like.

Referring to FIGS. 6 and 7, the first transmission area TA1 in the first optical area OA1 can have a structure (e.g., a recess, trench, concave, protrusion, etc.) in which the first planarization layer PLN1 and the passivation layer PAS0 have depressed portions that extend downward from respective surfaces thereof toward the substrate SUB as a transmittance improvement structure TIS.

Referring to FIGS. 6 and 7, among the plurality of insulating layers, the first planarization layer PLN1 may include at least one depression (e.g., a recess, a trench, a concave portion, a protrusion, or the like). The first planarization layer PLN1 may be, for example, an organic insulating layer.

In the example where the first planarization layer PLN1 has the depressed portion that extends downward from the surfaces thereof, the second planarization layer PLN2 can substantially serve to provide planarization. In one embodiment, the second planarization layer PLN2 may also have a depressed portion that extends downward from the surface thereof. In this embodiment, the second encapsulation layer PCL can substantially serve to provide planarization.

Referring to FIGS. 6 and 7, the depressed portions of the first planarization layer PLN1 and the passivation layer PAS0 may pass through insulating layers, such as the first interlayer insulating layer ILD, the second interlayer insulating layer ILD2, the gate insulating layer GI, and the like, for forming the transistor DRT, and buffer layers, such as the first active buffer layer ABUF1, the second active buffer layer ABUF2, the multi-buffer layer MBUF, and the like, located under the insulating layers, and extend up to an upper portion of the second substrate SUB2.

Referring to FIGS. 6 and 7, the substrate SUB may include at least one concave portion or depressed portion as a transmittance improvement structure TIS. For example, in the first transmission area TA1, an upper portion of the second substrate SUB2 may be indented or depressed downward, or the second substrate SUB2 may be perforated.

Referring to FIGS. 6 and 7, the first encapsulation layer PAS1 and the second encapsulation layer PCL included in the encapsulation layer ENCAP may also have a transmittance improvement structure TIS in which the first encapsulation layer PAS1 and the second encapsulation layer PCL have depressed portions that extend downward from the respective surfaces thereof. The second encapsulation layer PCL may be, for example, an organic insulating layer.

Referring to FIG. 7, to protect the touch sensor TS, the protective layer PAC may be disposed to cover the touch sensor TS on the encapsulation layer ENCAP.

Referring to FIG. 7, the protective layer PAC may have at least one depression (e.g., a recess, a trench, a concave portion, a protrusion, or the like) as a transmittance improvement structure TIS in a portion overlapping the first transmission area TA1. The protective layer PAC may be, for example, an organic insulating layer.

Referring to FIG. 7, the touch sensor TS may include one or more touch sensor metals TSM with a mesh type. In the example where the touch sensor metal TSM is formed in the mesh type, a plurality of openings may be formed in the touch sensor metal TSM. Each of the plurality of openings may be located to correspond to the light emitting area EA of the pixel SP.

In order for the first optical area OA1 to have a transmittance higher than the normal area NA, an area or size of the touch sensor metal TSM per unit area in the first optical area OA1 may be less than an area or size of the touch sensor metal TSM per unit area in the normal area NA.

Referring to FIG. 7, the touch sensor TS may be disposed in the light emitting area EA in the first optical area OA1, but may not be disposed in the first transmission area TA1 in the first optical area OA1.

Next, a stack structure of the second optical area OA2 will be described with reference to FIGS. 6 and 7.

Referring to FIGS. 6 and 7, the light emitting area EA of the second optical area OA2 may have the same stack structure as that of the normal area NA. Accordingly, in the discussion that follows, instead of repeatedly describing the light emitting area EA in the second optical area OA2, a stack structure of the second transmission area TA2 in the second optical area OA21 will be described in detail below.

The cathode electrode CE may be disposed in the light emitting areas EA included in the normal area NA and the second optical area OA2, but may not be disposed in the second transmission area TA2 in the second optical area OA2. For example, the second transmission area TA2 in the second optical area OA2 may be corresponded to an opening of the cathode electrode CE.

Further, a light shield layer LS including at least one of the first metal layer ML1 and the second metal layer ML2 may be disposed in the light emitting areas EA included in the normal area NA and the second optical area OA2, but may not be disposed in the first transmission area TA2 in the second optical area OA2. For example, the second transmission area TA2 in the second optical area OA2 may be corresponded to an opening of the light shield layer LS.

In an example where the transmittance of the second optical area OA2 and the transmittance of the first optical area OA1 are the same, the stack structure of the second transmission area TA2 in the second optical area OA2 may be the same as the stacked structure of the first transmission area TA1 in the first optical area OA1.

In another example where the transmittance of the second optical area OA2 and the transmittance of the first optical area OA1 are different, the stack structure of the second transmission area TA2 in the second optical area OA2 may be different at least in part from as the stacked structure of the first transmission area TA1 in the first optical area OA1.

For example, as shown in FIGS. 6 and 7, when the transmittance of the second optical area OA2 is less than the transmittance of the first optical area OA1, the second transmission area TA2 in the second optical area OA2 may not have a transmittance improvement structure TIS. As a result, the first planarization layer PLN1 and the passivation layer PAS0 may not be indented or depressed. Further, a width of the second transmission area TA2 in the second optical area OA2 may be less than a width of the first transmission area TA1 in the first optical area OA1.

The substrate SUB, and the various types of insulating layers (MBUF, ABUF1, ABUF2, GI, ILD1, ILD2, PAS0, PLN (PLN1, PLN2), BANK, ENCAP (PAS1, PCL, PAS2), T-BUF, T-ILD, PAC) disposed in the light emitting areas EA included in the normal area NA and the second optical area OA2 may be disposed in the second transmission area TA2 in the second optical area OA2 equally, substantially equally, or similarly.

However, all, or one or more, of one or more material layers having electrical properties (e.g., a metal material layer, a semiconductor layer, etc.), except for the insulating materials or layers, disposed in the light emitting areas EA included in the normal area NA and the second optical area OA2 may not be disposed in the second transmission area TA2 in the second optical area OA2.

For example, referring to FIGS. 6 and 7, all, or one or more, of the metal material layers (ML1, ML2, GATE, GM, TM, SD1, SD2) related to at least one transistor and the semiconductor layer ACT may not be disposed in the second transmission area TA2 in the second optical area OA2.

Further, referring to FIGS. 6 and 7, the anode electrode AE and the cathode electrode CE included in the light emitting element ED may not be disposed in the second transmission area TA2. In some embodiments, the emission layer EL of the light emitting element ED may or may not be disposed on the second transmission area TA2 according to a design requirement.

Further, referring to FIG. 7, the touch sensor metal TSM and the bridge metal BRG included in the touch sensor TS may not be disposed in the second transmission area TA2 in the second optical area OA2.

Accordingly, the light transmittance of the second transmission area TA2 in the second optical area OA2 can be provided or improved because the material layers (e.g., the metal material layer, the semiconductor layer, etc.) having electrical properties are not disposed in the second transmission area TA2 in the second optical area OA2. As a consequence, the second optical electronic device 12 can perform a predefined function (e.g., approach detection of an object or human body, external illumination detection, etc.) by receiving light transmitting through the second transmission area TA2.

Figure 8:
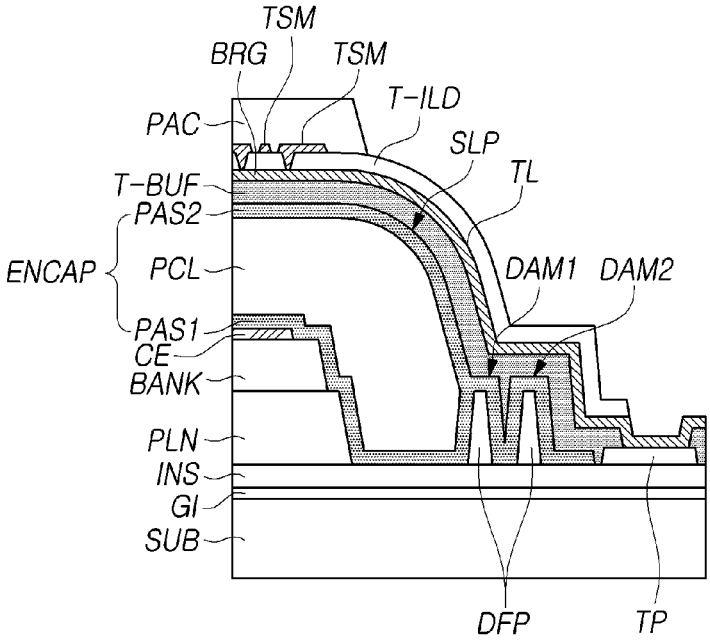
FIG. 8 is a cross-sectional view of an edge of the display panel according to embodiments of the present disclosure.

FIG. 8 is a cross-sectional view of an edge of the display panel 110 according to embodiments of the present disclosure.

Figure 9:
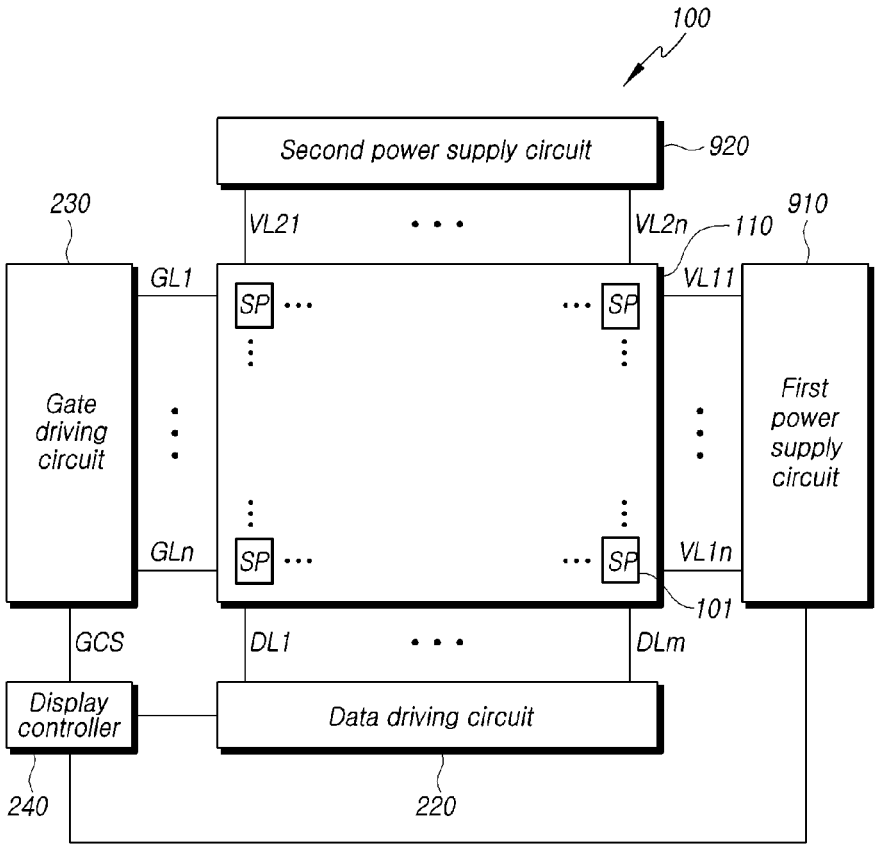
FIG. 9 illustrates a system configuration of the display device according to embodiments of the present disclosure.

For simplicity of illustration, FIG. 8 illustrates a single substrate SUB including the first substrate SUB1 and the second substrate SUB2, and layers or portions located under the bank BANK are shown in a simplified structure as well. Likewise, FIG. 9 illustrates a single planarization layer PLN including the first planarization layer PLN1 and the second planarization layer PLN2, and a single interlayer insulating layer INS including the second interlayer insulating layer ILD2 and the first interlayer insulating layer ILD1 located under the planarization layer PLN.

Referring to FIG. 8, the first encapsulation layer PAS1 may be disposed on the cathode electrode CE and disposed closest to the light emitting element ED. The second encapsulation layer PCL may have a smaller area or size than the first encapsulation layer PAS1. For example, the second encapsulation layer PCL may be disposed to expose both ends or edges of the first encapsulation layer PAS1.

The third encapsulation layer PAS2 may be disposed over the substrate SUB over which the second encapsulation layer PCL is disposed such that the third encapsulation layer PAS2 covers the respective top surfaces and side surfaces of the second encapsulation layer PCL and the first encapsulation layer PAS1.

The third encapsulation layer PAS2 can reduce or prevent external moisture or oxygen from penetrating into the first encapsulation layer PAS1 and the second encapsulation layer PCL.

Referring to FIG. 8, in order to prevent or at least reduce the encapsulation layer ENCAP from collapsing, the display panel 110 may include one or more dams (DAM1, DAM2) at, or near to, an end or edge of an inclined surface SLP of the encapsulation layer ENCAP. The one or more dams (DAM1, DAM2) may be present at, or near to, a boundary point between the display area DA and the non-display area NDA.

The one or more dams (DAM1, DAM2) may include the same material DFP as the bank BANK.

Referring to FIG. 8, in one embodiment, the second encapsulation layer PCL including an organic material may be located only on an inner side of a first dam DAM1, which is located closest to the inclined surface SLP of the encapsulation layer ENCAP among the dams. For example, the second encapsulation layer PCL may not be located on all of the dams (DAM1, DAM2). In another embodiment, the second encapsulation layer PCL including an organic material may be located on at least the first dam DAM1 of the first dam DAM1 and a second dam DAM2.

For example, the second encapsulation layer PCL may extend only up to all, or at least a portion, of an upper portion of the first dam DAM1. In further another embodiment, the second encapsulation layer PCL may extend past the upper portion of the first dam DAM1 and extend up to all, or at least a portion of, an upper portion of the secondary dam DAM2.

Referring to FIG. 8, a touch pad TP, to which the touch driving circuit 260 is electrically connected, may be disposed on a portion of the substrate SUB outside of the one or more dams (DAM1, DAM2).

A touch line TL can electrically connect, to the touch pad TP, the touch sensor metal TSM or the bridge metal BRG included in, or serving as, a touch electrode disposed in the display area DA.

One end or edge of the touch line TL may be electrically connected to the touch sensor metal TSM or the bridge metal BRG, and the other end or edge of the touch line TL may be electrically connected to the touch pad TP.

The touch line TL may run downward along the inclined surface SLP of the encapsulation layer ENCAP, run along the respective upper portions of the dams DAM1, DAM2, and extend up to the touch pad TP disposed outside of the dams (DAM1, DAM2).

Referring to FIG. 8, in one embodiment, the touch line TL may be the bridge metal BRG. In another embodiment, the touch line TL may be the touch sensor metal TSM.

FIG. 9 illustrates a system configuration of the display device according to embodiments of the present disclosure.

Referring to FIG. 9, the display device 100 can include a display panel 110, a data driving circuit 220, a gate driving circuit 230, a first power supply circuit 910, and a second power supply circuit 920 according to one embodiment.

The display panel 110 may include a plurality of data lines DL1 to DLm, a plurality of gate lines GL1 to GLn, a plurality of first initialization power lines VL11 to VL1*n*, and a plurality of power lines VL21 to VL2*n*, and a plurality of pixels 101 that are connected to the plurality of data lines DL1 to DLm, the plurality of gate lines GL1 to GLn, the plurality of first initialization power lines VL11 to VL1*n*, and the plurality of power supply lines VL21 to VL2*n*, and the plurality of pixels 101 are configured to emit light.

At least one of the plurality of pixels 101 can include a light emitting element for generating a driving current in response to a voltage corresponding to a data signal, and emitting light by receiving the driving current.

The data driving circuit 220 can be connected to the plurality of data lines DL1 to DLm and supply data signals to the plurality of data lines DL1 to DLm. The data driving circuit 220 may be implemented in an integrated circuit. The data driving circuit 220 can receive an image signal, which is a digital signal, and generate and supply a data signal, which is an analog signal.

The gate driving circuit 230 can be connected to the plurality of gate lines GL1 to GLn and supply gate signals to the plurality of gate lines GL1 to GLn. Although the gate driving circuit 230 is illustrated as being located outside of the display panel 110, in some instances, the gate driving circuit 230*t* may be disposed in the display panel 110.

The first power supply circuit 910 can supply a first initialization voltage to the plurality of first initialization power lines VL11 to VL1*n*. The first initialization voltage may have a voltage level between a first voltage level and a second voltage level. The first initialization voltage may have the first voltage level in a first period, a third voltage level between the first voltage level and the second voltage level in a second period, and the second voltage level in a third period. The second voltage level is less than the first voltage level and the third voltage level in one embodiment. Here, the first period, the second period, and the third period may be consecutive time periods. Although the first power supply circuit 910 is illustrated as being located outside of the display panel 110, in some instances, the first power supply circuit 910 may be disposed in the display panel 110.

The second power supply circuit 920 can supply a driving voltage to the plurality of power lines VL21 to VL2*n*. The driving voltage supplied from the second power supply circuit 920 may include a pixel driving voltage, which is a voltage having a high level, and a base voltage, which is a voltage having a low level. The voltage level of the pixel driving voltage may be less than a first voltage level of the first initialization voltage. The voltage level of the pixel driving voltage may be the same (e.g., matches) as a third voltage level of the first initialization voltage. The second power supply circuit 920 can also supply a second initialization voltage. However, voltage supplied from the second power supply circuit 920 is not limited thereto.

Further, the display device 100 can include a display controller 240 capable of controlling the data driving circuit 220, the gate driving circuit 230, the first power supply circuit 910, and the second power supply circuit 920. The display controller 240 can output an image signal, a clock signal, and a synchronization signal.

A touch sensor for sensing a touch may be disposed on the display device 100 to overlap the display panel 110.

At least one of the data driving circuit 220, the gate driving circuit 230, the first power supply circuit 910, and the second power supply circuit 320 may include a logic circuit. In situations where the display device 100 operates at a low frequency, a time for which the logic circuit operates can be reduced, and thus, power consumption in the data driving circuit 220, the gate driving circuit 230, the first power supply circuit 910, or the second power supply circuit 320 including the logic circuit can be reduced, resulting in the power consumption of the display device 100 being reduced.

Figure 10:
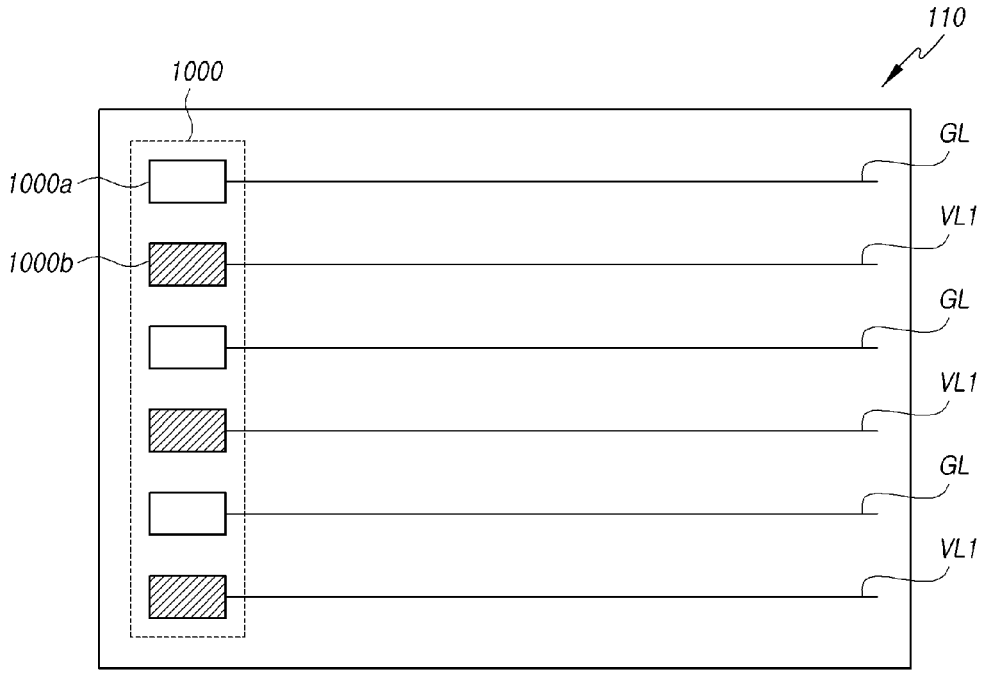
FIG. 10 illustrates a gate driving circuit and a first power supply circuit disposed in the display panel illustrated in FIG. 9 according to embodiments of the present disclosure.

FIG. 10 illustrates the gate driving circuit and the first power supply circuit disposed in the display panel illustrated in FIG. 9 according to one embodiment.

Referring to FIG. 10, the display panel 110 may include the substrate as previously described above. A plurality of pixels 101 may be disposed on the substrate SUB. Further, various types of signal lines to drive the plurality of pixels 101 may be disposed in the display panel 110.

A plurality of stages 1000 may be disposed on one side of the substrate SUB. However, embodiments of the present disclosure are not limited thereto. For example, a plurality of stages 1000 may be disposed on each of both sides of the substrate SUB.

The gate driving circuit 230 and the first power supply circuit 910 shown in FIG. 9 may be disposed on the display panel 110 using the plurality of stages 1000. The gate driving circuit 230 of FIG. 9 can be implemented by stages 1000*a* shown as boxes not having hatching among the plurality of stages 1000, and the first power supply circuit 910 of FIG. 9 can be implemented by stages 1000*b* shown as boxes having hatching among the plurality of stages 1000. However, the arrangement of the stages (1000*a*, 1000*b*) in the display panel 110 is not limited thereto.

The stages 1000*a* included in the gate driving circuit 220 can sequentially output a gate signal to the plurality of gate lines GL, and the stages 1000*b* included in the first power supply circuit 910 can sequentially apply a first initialization voltage to the plurality of first initialization power line VL1. The gate driving circuit 220 and the first power supply circuit 910 are illustrated as including three stages, respectively, but embodiments of the present disclosure are not limited thereto.

Further, although it is illustrated that only the plurality of stages 100 are disposed on the substrate SUB for ease of description, but embodiments of the present disclosure are not limited thereto. The plurality of stages (1000*a*, 1000*b*) included in the gate driving circuit 220 and the first power supply circuit 910 can be disposed during the process of disposing pixels on the substrate SUB, thus, the process of manufacturing the display device 100 can be more simplified when compared with separately connecting the gate driving circuit 220 and the first power supply circuit 910.

The gate driving circuit 220 and the first power supply circuit 910 may be disposed in the non-display area on the substrate SUB. In the example where the gate driving circuit 220 and the first power supply circuit 910 are disposed in the non-display area, the bezel of the display device 100 can be thinner.

Figure 11:
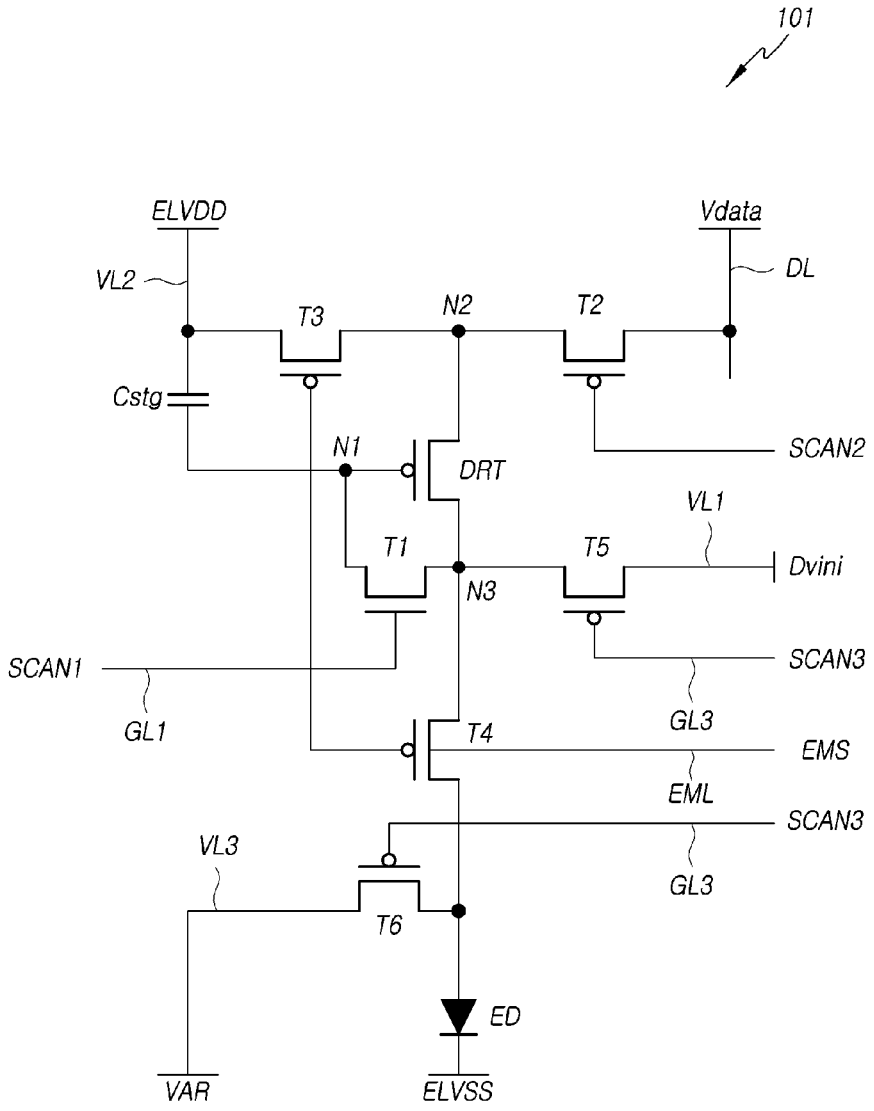
FIG. 11 illustrates a circuit diagram of a pixel employed in the display device illustrated in FIG. 9 according to embodiments of the present disclosure.

FIG. 11 illustrates a circuit diagram of a pixel employed in the display device illustrated in FIG. 9 according to one embodiment.

Referring to FIG. 11, the pixel 101 may include a driving transistor DRT for enabling a driving current to flow from a second node N2 to a third node N3 in response to the voltage of a first node N1 to which a voltage corresponding to a data signal is applied, and a light emitting element ED for emitting light by the driving current from the driving transistor DRT.

First and second electrodes of the driving transistor DRT may connected to the second node N2 and the third node N3, respectively. The gate electrode of the driving transistor DRT may be connected to the first node N1. A voltage corresponding to a data signal may be applied to the first node N1. In a situation where a pixel driving voltage ELVDD is applied to the second node N2, the driving transistor DRT can enable a current to flow from the second node N2 to the node N3 according to a level of the voltage applied to the first node N1.

The light emitting element ED may include an anode electrode, a cathode electrode, and an emission layer disposed between the anode electrode and the cathode electrode. A base voltage ELVSS can be applied to the cathode electrode of the light emitting element ED. The base voltage applied to the cathode electrode of the light emitting element ED may be a ground or negative voltage, and when a voltage having a high level is applied to the anode electrode of the light emitting element ED, current can flow from the anode electrode to the cathode electrode of the light emitting element ED. Accordingly, the light emitting element ED can emit light.

The light emitting element ED may be, for example, an organic light emitting diode (OLED), an inorganic light emitting diode, a quantum dot light emitting element, or the like. In the example where an organic light emitting diode is used as the light emitting element ED, the emission layer EL included in the light emitting element ED may include an organic emission layer including an organic material.

The pixel 101 may include a first transistor T1 connected between the first node N1 and the third node N3 and turned on in response to a first gate signal SCAN1, a second transistor T2 connected between one data line DL of a plurality of data lines and the second node N2, and turned on in response to a second gate signal SCAN2, a third transistor T3 connected between a driving power line VL2 connected to a pixel driving power supply for supplying a pixel driving voltage ELVDD and the second node N2, and turned on in response to an emission signal EMS, a fourth transistor T4 connected between the third node N3 and the anode electrode of the light emitting element ED, and turned on in response to the emission signal EMS, a fifth transistor T5 disposed between a first initialization voltage line VL1 for transmitting a first initialization voltage Dvini and the third node N3, and turned on in response to a third gate signal SCAN3, and a storage capacitor Cstg connected between the first node N1 and the driving power line VL2.

The pixel 101 may include a sixth transistor T6 disposed between the anode electrode of the light emitting element ED and a second initialization power line VL3 for applying a second initialization voltage VAR to the anode electrode of the light emitting element ED, and turned on in response to the third gate signal SCAN3.

The gate electrode of the first transistor T1 may be connected to a first gate line GL1, and thus, the first transistor T1 can be turned on/off in response to the first gate signal SCAN1 delivered through the first gate line GL1. When the first transistor T1 is turned on, the first node N1 and the third node N3 can be conductively connected, and thus the driving transistor DRT may enter a diode-connected state.

The gate electrode of the second transistor T2 may be connected to a second gate line GL2, and thus, the second transistor T2 can be turned on/off in response to the second gate signal SCAN2 delivered through the second gate line GL2. When the second transistor T2 is turned on, a voltage corresponding to a data signal Vdata delivered through the data line DL can be transmitted to the second node N2.

The gate electrode of the third transistor T3 may be connected to an emission line EML, and thus, the third transistor T3 can be turned on/off in response to the emission signal EMS delivered through the emission line EML. When the third transistor T3 is turned on by the emission signal EMS, the pixel driving power line for supplying the pixel driving voltage ELVDD and the second node N2 can be connected, and thus, the pixel driving voltage ELVDD can be applied to the second node N2.

The gate electrode of the fourth transistor T4 may be connected to the emission line EML, and thus, the fourth transistor T4 can be turned on/off in response to the emission signal EMS delivered through the emission line EML. When the fourth transistor T4 is turned on by the emission signal EMS, the third node N3 and the anode electrode of the light emitting element ED can be connected, and thus, a driving current flowing through the third node N3 can be applied to the light emitting element ED.

The gate electrode of the fifth transistor T5 may be connected to a third gate line GL3, and thus, the fifth transistor T5 can be turned on/off in response to the third gate signal SCAN3 delivered through the third gate line GL3. When the fifth transistor T5 is turned on by the third gate signal SCAN3, the first initialization voltage Dvini transmitted to the first initialization signal line VL1 can be transmitted to the third node N3. Since the first initialization voltage Dvini has a higher voltage level than the pixel driving voltage ELVDD, in a situation where a data signal Vdata is applied to the gate electrode of the driving transistor DRT, the first initialization voltage Dvini can be transmitted to the second node N2 through the driving transistor DRT. Accordingly, the second node N2 and the third node N3 can be initialized by the first initialization voltage Dvini.

The gate electrode of the sixth transistor T6 may be connected to the third gate line GL3, and thus, the sixth transistor T6 can be turned on/off in response to the third gate signal SCAN3 delivered through the third gate line GL3. When the sixth transistor T3 is turned on by the third gate signal SCAN3, the second initialization voltage VAR transmitted to the second initialization signal line VL3 can be transmitted to the anode electrode of the light emitting element ED, and thus, the voltage of the anode electrode can be initialized by the second initialization voltage VAR.

The first transistor T1 may be a transistor using oxide semiconductor as an N-type MOS transistor, and the driving transistor DRT and the second to sixth transistors T2 to T6 may be low-temperature polysilicon transistors as P-type MOS transistors. However, embodiments of the present disclosure are not limited to these types of transistors.

The transistor using the oxide semiconductor can reduce an amount of leakage current compared to the low-temperature polysilicon transistor. In contrast, the low-temperature polysilicon transistor can have an advantage of higher carrier mobility than the transistor using the oxide semiconductor.

Accordingly, if the voltage of the first node N1 is lowered by a leakage current and the image quality of the display device may be deteriorated, the first transistor T1 may be therefore a transistor using the oxide semiconductor, and the driving transistor DRT and the second to sixth transistors T2 to T6 may be low-temperature polysilicon transistors. Further, in the example where the pixel 101 includes a transistor using the oxide semiconductor, an amount of leakage current can be reduced, this enabling the display device 100 be implemented in a larger size.

First and second electrodes of the storage capacitor Cstg may be connected to the driving power line VL2 connected to the pixel driving power supply for supplying the pixel driving voltage ELVDD and the first node N1, respectively, and can maintain the voltage of the first node N1.

Here, the first gate line GL1, the second gate line GL2, the third gate line GL3, and the emission line EML may correspond to the horizontal lines HL1 and HL2 illustrated in FIG. 5. However, embodiments of the present disclosure are not limited thereto.

Figure 12:
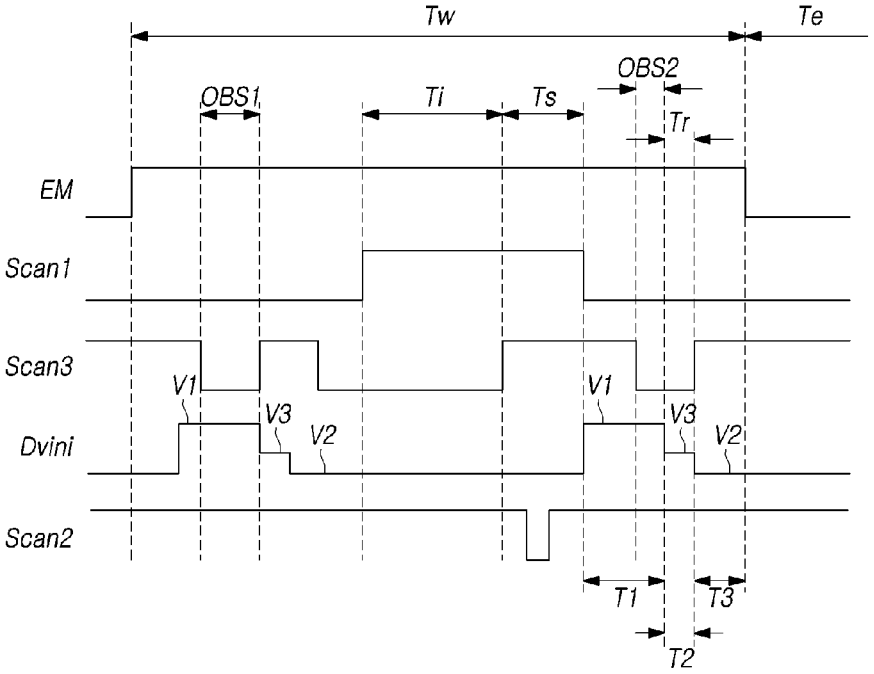
FIG. 12 is a timing diagram illustrating the operation of the pixel illustrated in FIG. 11 according to embodiments of the present disclosure.

FIG. 12 is a timing diagram illustrating the operation of the pixel illustrated in FIG. 11 according to one embodiment.

Referring to FIG. 12, the pixel 101 can operate in a data writing period Tw and an emission period Te, which are distinct from each other. That is, the data writing period Tw and the emission period Te are non-overlapping. The data writing period Tw refers to a period in which a data signal Vdata is applied or written to the gate electrode of the driving transistor DRT shown in FIG. 11, and the emission period Te refers to a period in which the driving transistor DRT supplies a driving current to the light emitting element ED by the data signal Vdata applied to the gate electrode of the driving transistor DRT.

The data writing period Tw may include a first on-bias stress period OBS1, an initialization period Ti, a sensing period Ts, a second on-bias stress period OBS2, and a reset period Tr according to one embodiment.

The first on-bias stress period OBS1 and the second on-bias stress period OBS2 may be periods in which a voltage having a high level is applied to the driving transistor DRT. Even when the voltage applied to the driving transistor DRT varies, a hysteresis problem may occur in that a driving current varied according to the magnitude of the varied voltage does not flow. However, if the voltage having the high level is applied to the driving transistor DRT, the hysteresis of the driving transistor DRT can be reduced or removed.

During the data writing period Tw, a driving current does not flow to the light emitting element ED. In a situation where the third transistor T3 and the fourth transistor T4 are off, the driving power line VL2 connected to the driving power supply and the second node N2 can be electrically disconnected, and the third node N3 and the light emitting element ED can be electrically disconnected. Accordingly, no current flows from the driving transistor DRT to the light emitting element ED. Since the third transistor T3 and the fourth transistor T4 connected to the emission line EML are P-type MOS transistors, when a signal having a high level is supplied, these transistors T3 and T4 are off, and therefore, in the data writing period Tw, an emission signal EMS flowing through the emission line EML can be supplied with the high level.

Further, in the first on-bias stress period OBS1, the first gate signal SCAN1 and the third gate signal SCANS may have a low level, and the second gate signal SCAN2 may have a high level. When the first gate signal SCAN1 has the low level, the first transistor T1 is off because the first transistor T1 is an N-type MOS transistor. Since the second gate signal SCAN2 has the high level, the second transistor T2 can be off, and therefore, a data signal Vdata transmitted through the data line DL cannot be supplied to the second node N2. Since the third gate signal SCAN3 has the low level, the fifth transistor T5 can be turned on, and therefore, the first initialization voltage Dvini can be transmitted to the third node N3.

Since the first initialization voltage Dvini transmitted to the third node N3 is higher than the driving voltage, the first initialization voltage Dvini with a first voltage level V1 can be transmitted from the third node N3 to the second node N2, and as a result, the hysteresis of the driving transistor DRT can be reduced or removed by the first initialization voltage Dvini.

In the initialization period Ti, the first gate signal SCAN1 may have a high level, the second gate signal SCAN2 may have the high level, and the third gate signal SCAN3 may have the low level. When the first gate signal SCAN1 has the high level, the first transistor T1 can be turned on. When the first transistor T1 is turned on, the first node N1 and the third node N3 can be connected, this enabling the first transistor T1 to become diode-connected.

Since the third gate signal SCAN3 has the low level, the fifth transistor T5 can be on, and therefore, the first initialization voltage Dvini can be transmitted to the third node N3. The first initialization voltage Dvini transmitted to the third node N3 may have a second voltage level V2 that is less than the first voltage level V1, and be transmitted to the first node N1 and the second node N2. Accordingly, the first to third nodes N1 to N3 can be initialized by the first initialization voltage Dvini with the second voltage level V2.

In the sensing period Ts, the first gate signal SCAN1 may have the high level, and the third gate signal SCAN3 may have a high level, and while the first gate signal SCAN1 and the third gate signal SCAN3 remain at the high level, the second gate signal SCAN2 may have a low level during 1H period (one horizontal period). Since the first gate signal SCAN1 and the third gate signal SCAN3 are at the high level, the first transistor T1 can be on, and the fifth transistor T5 can be turned off.

When the second gate signal SCAN2 has the low level, the second transistor T2 is turned on, and a data signal Vdata flowing through the data line DL can be transmitted to the second node N2. At this time, since the first transistor T1 remains on, a current can flow from the second node N2 to the third node N3 by the data signal Vdata applied to the second node N2, and a voltage corresponding to the current flowing from the second node N2 to the third node N3 may be applied or written to the first node N1. The voltage applied or written to the second node N2 may be a voltage corresponding to the data signal Vdata and the threshold voltage of the driving transistor DRT.

In the second on-bias stress period OBS2, the first gate signal SCAN1 and the third gate signal SCAN3 may have the low level, and the second gate signal SCAN2 may have the high level. The first transistor T1 can be off by the first gate signal SCAN1, and the second transistor T2 can be off by the second gate signal SCAN2. The fifth transistor T5 can be turned on by the third gate signal SCAN3.

While the first gate signal SCAN1 has the low level, the first transistor T1 is off. Since the second gate signal SCAN2 has the high level, the second transistor T2 can be off, and therefore, a data signal Vdata transmitted through the data line DL cannot be supplied to the second node N2. Since the fifth transistor T5 is on, the first initialization voltage Dvini can be transmitted to the third node N3. Since the first initialization voltage Dvini transmitted to the third node N3 is higher than the pixel driving voltage ELVDD, the first initialization voltage Dvini having the first level V1 transmitted to the third node N3 can be transmitted to the second node N2. Accordingly, the hysteresis of the first transistor T1 can be reduced or removed as the first initialization voltage Dvini is applied to the second node N2 and the third node N3.

In particular, when the display device 100 is driven at a relatively low frequency, a period in which a voltage applied to the driving transistor DRT varies is very long, and therefore, an effect of reducing or removing the hysteresis of the driving transistor DRT can become much bigger by the first initialization voltage Dvini applied in the first on-bias stress period OBS1 and the second on-bias stress period OBS2. Further, when the display device 100 is driven at the low frequency, power consumption of the display device 100 can be reduced.

During the second on-bias period OBS2, as the first initialization voltage Dvini is applied to the second node N2, a voltage of the second node N2 can have a higher level than the pixel driving voltage ELVDD. When the emission period Te initiates in a situation where the voltage of the second node N2 has a higher level than the pixel driving voltage ELVDD, the third transistor T3 and the fourth transistor T4 can be turned on by the emission signal EMS, and the first transistor T1 enables, to flow from the second node N2 to the third node N3, a driving current having compensated for the threshold voltage of the first transistor T1 by a data signal Vdata stored in the first node N1 and a voltage corresponding to the threshold voltage of the first transistor T1, leading the driving current to flow through the light emitting element ED.

When the third transistor T3 is turned on, as the power line VL2 for supplying the pixel driving voltage ELVDD is connected to the second node N2, the voltage of the second node N2 can be lowered from a first voltage level of the first initialization voltage Dvini being higher than the pixel driving voltage ELVDD to the voltage level of the pixel driving voltage ELVDD. In this situation, it takes time for the voltage of the second node N2 to reach such a level (i.e., being lowered).

However, if the emission period Te is initiated in a situation where the voltage of the second node N2 is not sufficiently lowered, in the emission period Te, which is a period in which the driving current is supplied to the light emitting element ED, the voltage of the second node N2 can remain at a higher level than the voltage level of the pixel driving voltage ELVDD. As a result, a voltage difference between the pixel driving voltage ELVDD and the base voltage ELVSS can increase, and thereby, an amount of driving current flowing to the light emitting element ED can increase. In particular, when a pixel displays a low gray scale, an amount of driving current increases, and thereby, there is a probability of being displayed brighter than an intended level.

In order to address these issues, it is desired to initialize the second node N2 and the third node N3 to a voltage level corresponding to the voltage level of the pixel driving voltage ELVDD during the emission period Te. Accordingly, after the second on-bias stress period OBS2, a reset period Tr for initializing the second node N2 and the third node N3 to the voltage level of the pixel driving voltage ELVDD can be performed.

The first initialization voltage Dvini may have a voltage level between a first voltage level V1 and a second voltage level V2. The first initialization voltage Dvini may have a first voltage level V1 in a first period T1, a third voltage level V3, which is a voltage level between the first voltage level V1 and the second voltage level V2, in a second period T2 that is subsequent the first period T1, and the second voltage level V2 in a third period T3 that is subsequent the second period T2. The first period T1 may overlap the second OBS period OBS2, and the second period T2 may overlap the reset period Tr.

Accordingly, in the reset period Tr, the voltage level of the first initialization voltage Dvini transmitted to the second node N2 and the third node N3 can have the third voltage level V3 corresponding to the voltage level of the pixel driving voltage ELVDD. As a result, the second node N2 and the third node N3 have the same voltage level as the pixel driving voltage ELVDD, and thereby, an increase in an amount of driving current flowing through the pixel 101 can be prevented, or at least reduced. In turn, the image quality of the display device 100 can be improved.

In addition, since the second node N2 and the third node N3 can be reset to the voltage level of the pixel driving voltage ELVDD without adding a separate signal line to the pixel 101, even if the second node N2 and the third node N3 are reset, a decrease in an aperture ratio of the display device 100 can be prevented or reduced, and the design of the pixel 101 can be simplified. In particular, even when an additional line is not disposed in the pixel 101 of the display device 100, a decrease in an aperture ratio in each optical area (OA1, OA2) as shown in FIGS. 1A to 1C can be prevented or reduced.

Since the sixth transistor T6 is turned on/off in response to the third gate signal SCANS, the second initialization voltage Var for initializing the anode electrode of the light emitting element ED can be supplied in the first OBS period OBS1, the second OBS period OBS2, and the reset period Tr, and thereby, the anode electrode of the light emitting element ED can be initialized by the second initialization voltage Var.

Figure 13:
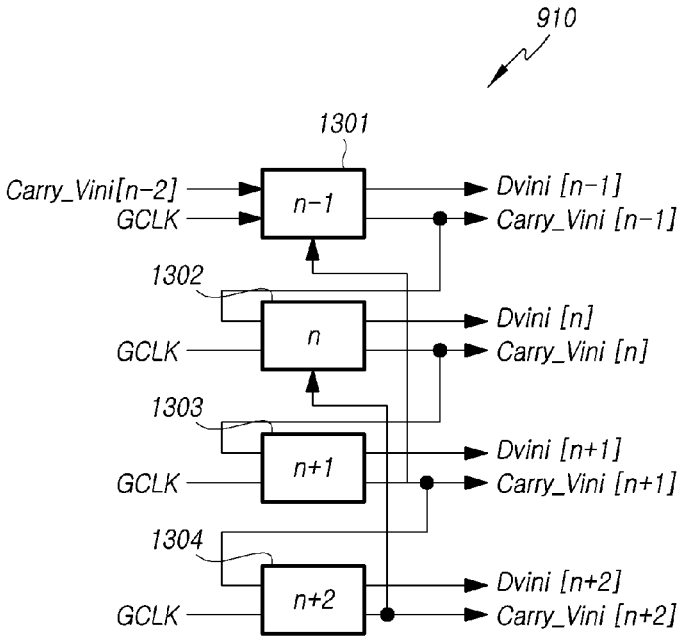
FIG. 13 illustrates the configuration of the first power supply circuit illustrated in FIG. 9 according to embodiments of the present disclosure.

FIG. 13 illustrates the configuration of the first power supply circuit illustrated in FIG. 9 according to one embodiment.

Referring to FIG. 13, the first power supply circuit 910 may include a plurality of stages 1301 to 1304. Each of the plurality of stages 1301 to 1304 may correspond to the stage 1000*b* illustrated in FIG. 10. The plurality of stages 1301 to 1304 can generate first initialization voltages (Dvini[n−1], Dvini[n], Dvini[n+1], Dvini[n+2]) and carry signals (Carry_Vini. [n−1], Carry_Vini[n], Carry_Vini[n+1], Carry_Vini [n+2]), which are respectively sequentially output.

Each of the plurality of stages 1301 to 1304 can receive a driving voltage VDD having a high voltage VGH having a first voltage level V1, a low voltage VGL having a second voltage level V2, and a driving voltage having a third voltage level V3, and output the first initialization voltage Dvini such that the voltage level of the first initialization voltage Dvini sequentially has the first voltage level V1, the third voltage level V3, and the second voltage level V3. The voltage level of the driving voltage VDD may be the same as the pixel driving voltage ELVDD illustrated in FIG. 11.

Further, the first initialization voltage Dvini supplied from the first power supply circuit 910 may include an (n−1)th first initialization voltage Dvini[n−1], an n-th first initialization voltage Dvini[n], an (n+1)-th first initialization voltage Dvini[n+1], and an (n+2)-th first initialization voltage Dvini [n+2], which are sequentially output. Further, the (n−1)th first initialization voltage (Dvini[n−1]) may refer to the first initialization voltage transmitted to a pixel receiving a data signal in response to a gate signal delivered through an (n−1)th gate line of a plurality of gate lines; the n-th first initialization voltage (Dvini[n]) may refer to the first initialization voltage transmitted to a pixel receiving a data signal in response to a gate signal delivered through an n-th gate line of the plurality of gate lines; the (n+1)th first initialization voltage (Dvini[n+1]) may refer to the first initialization voltage transmitted to a pixel receiving a data signal in response to a gate signal delivered through an (n+1)th gate line of a plurality of gate lines; and the (n+2)th first initialization voltage (Dvini[n+2]) may refer to the first initialization voltage transmitted to a pixel receiving a data signal in response to a gate signal delivered through an (n+2)th gate line of a plurality of gate lines.

The first power supply circuit 910 may include an (n−1)th stage 1301 for outputting an (n−1)th carry signal Carry_Vini [n−1] and the (n−1)th first initialization voltage Dvini[n−1], an n-th stage 1302 for outputting an n-th carry signal Carry_Vini[n] and the n-th first initialization voltage Dvini [n], an (n+1)-th stage 1303 for outputting an (n+1)-th carry signal Carry_Vini[n+1] and the (n+1)-th first initialization voltage Dvini[n+1], and an (n+2) stage 1304 for outputting an (n+2)-th carry signal Carry_Vini[n+2] and the (n+2)th first initialization voltage Dvini[n+2].

The n-th stage 1302 can output the n-th first initialization voltage Dvini[n] having the first voltage level V1 in response to the (n−1)th carry signal Carry_Vini[n−1] in the first period T1, and output the n-th first initialization voltage Dvini[n] having the third voltage level V3 corresponding to the driving voltage VDD in response to the (n+2)th carry signal Carry_Vini[n+2] in the second period T2.

Figure 14:
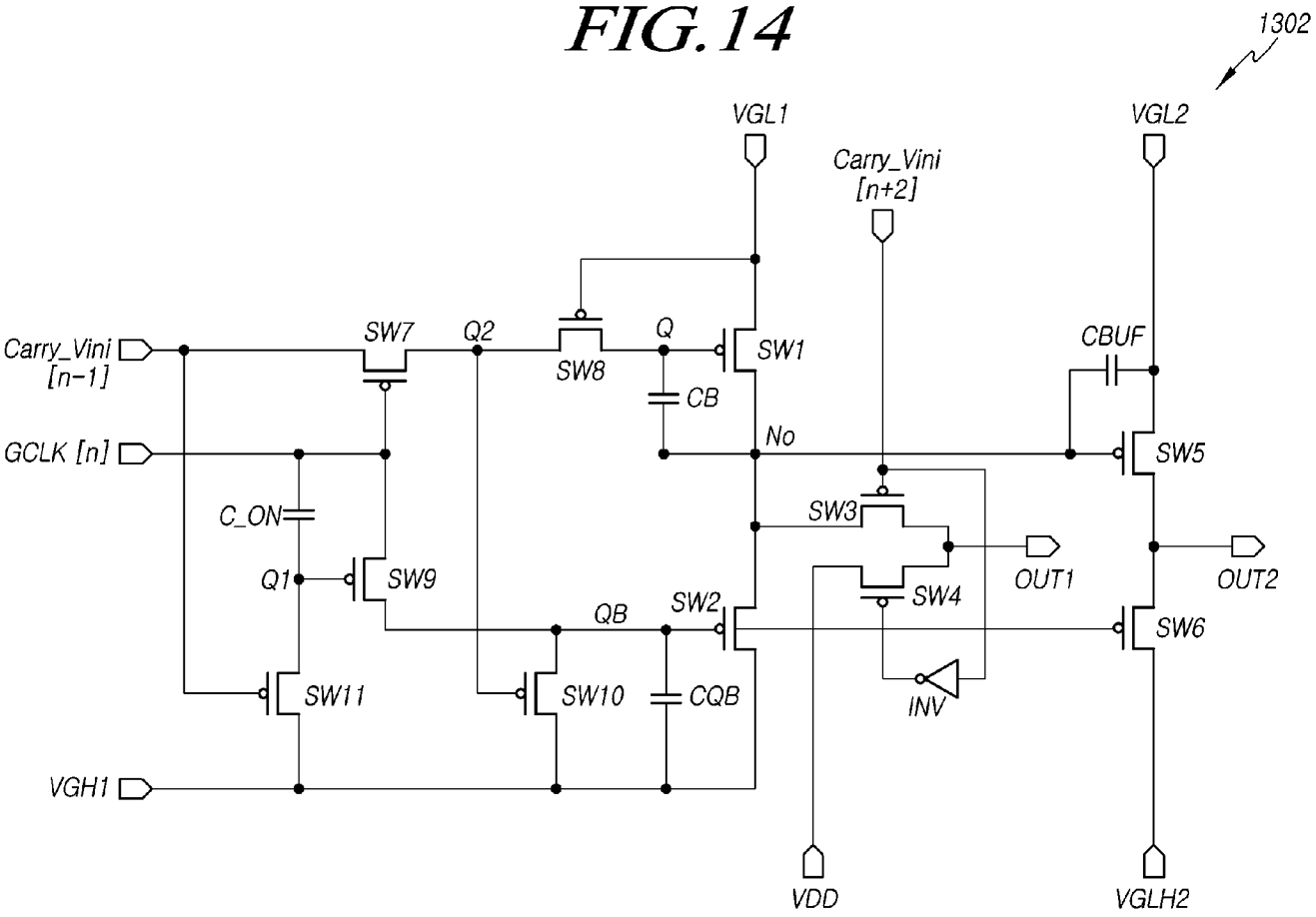
FIGS. 14 and 15 are circuit diagrams of an n-th stage illustrated in FIG. 13 according to embodiments of the present disclosure.
Figure 15:
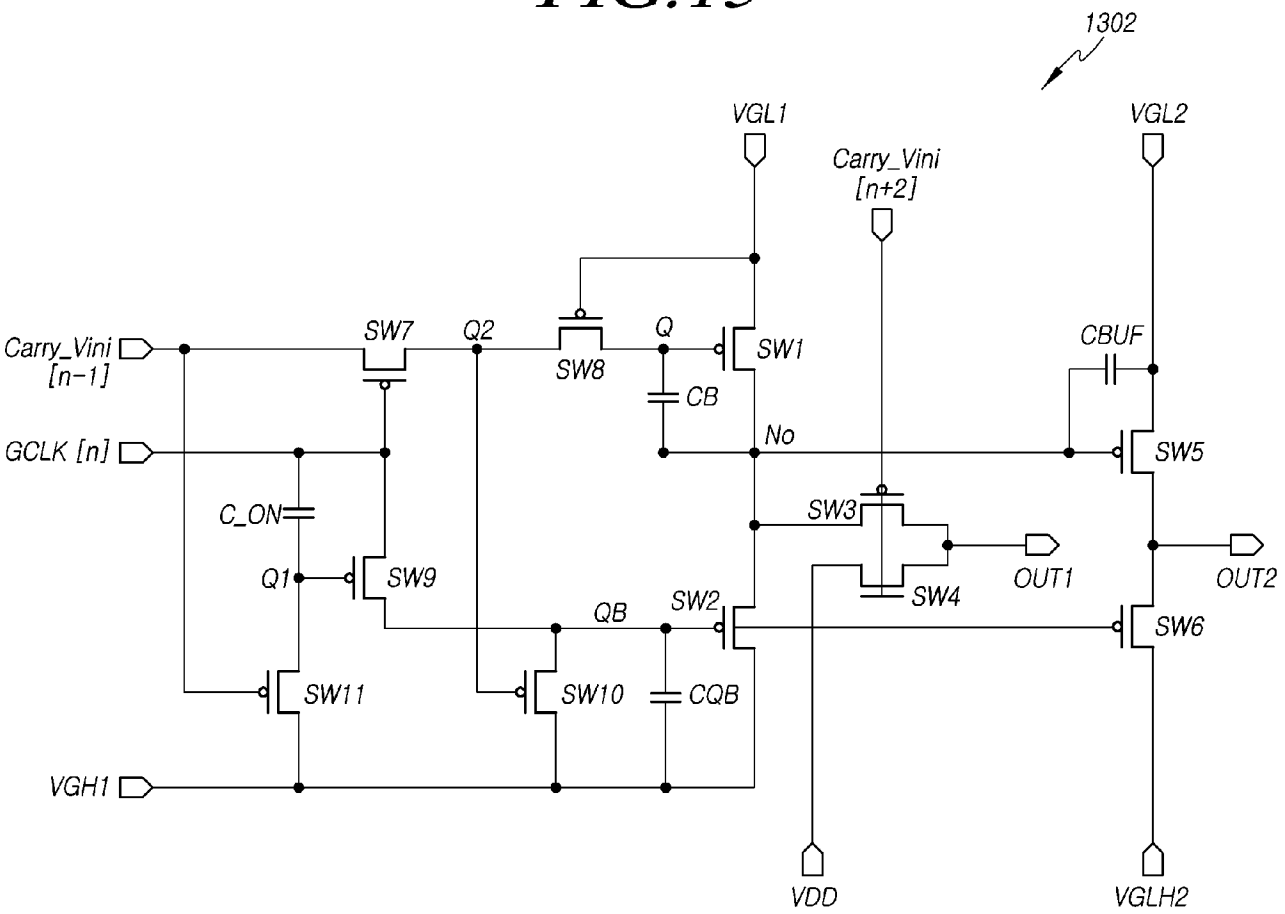

FIGS. 14 and 15 are circuit diagrams of the n-th stage illustrated in FIG. 13 according to one embodiment.

Referring to FIGS. 14 and 15, the n-th stage 1302 may include a first switch SW1 that includes a first electrode, a second electrode, and a gate electrode, which may be connected to a first low voltage supply for supplying a first low voltage VGL1, an output node No, and a Q node Q, respectively, and applies the first low voltage VGL1 to a first output node No by a voltage of the Q node Q according to the (n−1)th carry signal Carry_Vini[n−1]; a second switch SW2 that includes a first electrode, a second electrode, and a gate electrode, which may be connected to a first high voltage supply for supplying a first high voltage VGH1, the output node No, and a QB node QB, respectively, and applies the first high voltage VGH1 to the output node No by a voltage of the QB node QB according to the (n−1)th carry signal Carry_Vini[n−1]; a third switch Sw3 that includes a first electrode, a second electrode, and a gate electrode, which may be connected to the output node No, a first output terminal OUT1, and a carry signal line through which the (n+2)th carry signal Carry_Vini[n+2] is supplied, respectively; a fourth switch SW4 that includes a first electrode, a second electrode, and a gate electrode, which may be connected to a driving power supply for supplying a driving voltage VDD, the first output terminal OUT1, and the carry signal line through which the (n+2)th carry signal Carry_Vini[n+2] is supplied, respectively, and operates in a manner opposite to the third switch SW3; a fifth switch SW5 that includes a first electrode, a second electrode, and a gate electrode, which may be connected to a second low voltage supply for supplying a second low voltage VGL2, a second output terminal OUT2, and the output node No, respectively; and a sixth switch SW6 that includes a first electrode, a second electrode, and a gate electrode, which may be connected to a second high voltage supply for supplying a second high voltage VGH2, the second output terminal OUT2, and the QB node QB, respectively.

The n-th first initialization voltage Dvini[n] can be output to the first output terminal OUT1, and the n-th carry signal Carry_Vini[n] can be output to the second output terminal OUT2.

The first high voltage VGH1 may correspond to the first voltage level V1 of the first initialization voltage Dvini, and the first low voltage VGL1 may correspond to the second voltage level V2 of the first initialization voltage Dvini. The driving voltage VDD may correspond to the third voltage level V3 of the first initialization voltage Dvini.

In FIG. 14, the fourth switch SW4 can receive the (n+2)th carry signal Carry_Vini[n+2] through an inverter INV, and thereby, operate in the manner opposite to the third switch SW3. Further, in FIG. 15, the first to third switches SW1 to SW3, the fifth switch SW5, and the sixth switch SW6 may be P-type MOS transistors, and the fourth switch SW4 may be an N-type MOS transistor, and thereby, even if the third switch SW3 and the fourth switch SW4 receive the same (n+2)th carry signal Carry_Vini[n+2], the fourth switch SW4 can operate in the manner opposite to the third switch SW3. For example, when the third switch SW3 is turned on, the fourth switch SW4 can be turned off, and when the third switch SW3 is turned off, the fourth switch SW4 can be turned on.

Further, the n-th stage 1302 may include a first capacitor CB disposed between the Q node Q and the output node No, a second capacitor CQB disposed between the QB node QB and the high voltage supply for supplying the first high voltage VGH1, and a third capacitor CBUF disposed between the output node No and the low voltage supply for supplying the second low voltage VGL2. The voltage of the Q node Q can be maintained by the first capacitor CB. The voltage of the QB node QB can be maintained by the second capacitor CQB. A voltage difference between the output node No and the second low voltage supply may be maintained by the third capacitor CBUF.

Further, the n-th stage 1302 may include seventh to eleventh switches Ts7 to Ts11. The seventh switch SW7 and the eighth switch SW8 may be disposed in series between an input terminal to which the (n−1)th carry signal Carry_Dvini[n−1] is input and the Q node Q, and enable the (n−1)th carry signal Carry_Dvini[n−1] to be supplied to the Q node Q.

A clock signal GCLK can be supplied to the gate electrode of the seventh switch SW7, and thus, the seventh switch SW7 can be turned on/off in response to the clock signal GCLK.

The eighth switch SW8 can be turned on by the first low voltage VGL1.

The ninth switch SW9 may be disposed between the gate electrode of the seventh switch SW7 and the QB node QB. The tenth switch SW10 may be connected between the QB node QB and the high voltage supply for supplying the first high voltage VGH1, and the gate electrode thereof may be connected between the seventh switch SW7 and the eighth switch SW8. The eleventh switch SW11 may be disposed between the first high voltage supply and the gate electrode of the ninth switch SW9, and a clock signal input terminal to which the clock signal GCLK is input may be connected to the gate electrode of the eleventh switch SW11. Further, a fourth capacitor C_ON may be disposed between the gate electrode of the ninth switch SW9 and the clock signal input terminal.

Here, the voltage levels of the first high voltage VGH1 and the second high voltage VGH2 may be different from each other. The voltage levels of the first low voltage VGL1 and the second low voltage VGL2 may be different from each other. However, embodiments of the present disclosure are not limited thereto. In some embodiments, the first high voltage VGH1, the second high voltage VGH2, and the first low voltage VGL1 and the second low voltage VGL2 may be supplied to the first power supply circuit 910 from the second power supply circuit 920 shown in FIG. 9.

Figure 16:
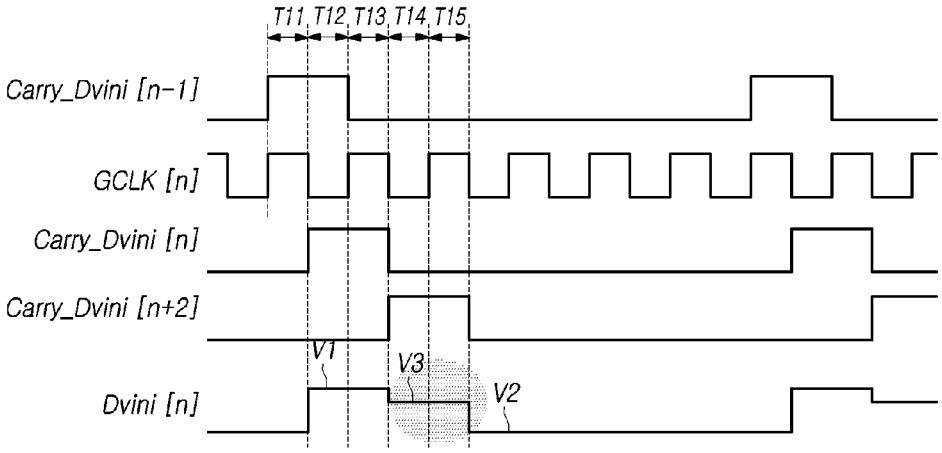
FIG. 16 is a timing diagram illustrating the operation of the stage illustrated in FIG. 14 or 15 according to embodiments of the present disclosure.

FIG. 16 is a timing diagram illustrating the operation of the stage illustrated in FIG. 14 or 15.

Referring to FIG. 16, in a first period T11, the (n−1)th carry signal Carry_Dvini[n−1] and the clock signal GCLK[n] may have high levels, and the (n+2)th carry signal Carry_Dvini[n+2] may have a low level. The second switch SW2, the seventh switch SW7, the ninth switch SW9, the tenth switch SW10, and the eleventh switch SW11 can be off, and the fifth switch SW5 can be on, by the (n−1)th carry signal Carry_Dvini[n−1] and the clock signal GCLK[n]. The third switch SW3 can be on, and the fourth switch SW4 can be off, by the (n+2)th carry signal Carry_Dvini[n+2] having the low level. The eighth switch SW8 can be on.

Accordingly, the first low voltage VGL1 supplied from the first low voltage supply can be output to the first output terminal OUT1 through the first switch SW1 and the third switch SW3, and thereby, the first initialization voltage Dvini[n] can have a second voltage level V2. Further, the second low voltage VGL2 supplied from the second low voltage supply can be output to the second output terminal OUT2 through the fifth switch SW5, and thereby, the n-th carry signal Carry_Dvini[n] can have a low level.

In a second period T12, the (n−1)th carry signal Carry_Dvini[n−1] may have the high level, the (n+2)th carry signal Carry_Dvini[n+2] may have the low level, and the clock signal GCLK[n] may have a low level. The first switch SW1, the fifth switch SW5, the seventh switch SW7, the tenth switch SW10, and the eleventh switch SW11 can be off, and the second switch SW2, the sixth switch SW6, and the ninth switch SW9 can be on, by the (n−1)th carry signal Carry_Dvini[n−1] and the clock signal GCLK[n]. The third switch SW3 can be on, and the fourth switch SW4 can be off, by the (n+2)th carry signal Carry_Dvini[n+2] having the low level. The eighth switch SW8 can be on.

Accordingly, the first high voltage VGH1 supplied from the first high voltage supply can be output to the first output terminal OUT1 through the second switch SW2 and the third switch SW3, and thereby, the first initialization voltage Dvini[n] can have a first voltage level V1. Further, the first high voltage VGH1 supplied from the first high voltage supply can be output to the second output terminal OUT2 through the sixth switch SW6, and thereby, the n-th carry signal Carry_Dvini[n] can be output with a high level.

In a third period T13, the (n−1)th carry signal Carry_Dvini[n−1] may have a low level, the (n+2)th carry signal Carry_Dvini[n+2] may have the low level, and the clock signal GCLK[n] may have the high level. The first switch SW1, the fifth switch SW5, the seventh switch SW7, the ninth switch SW9, and the tenth switch SW10 can be off, and the second switch SW2, the sixth switch SW6, and the eleventh switch SW11 can be on, by the (n−1)th carry signal Carry_Dvini[n−1] and the clock signal CCLK[n]. The third switch SW3 can be on, and the fourth switch SW4 can be off, by the (n+2)th carry signal Carry_Dvini[n+2] having the low level. The eighth switch SW8 can be on.

Accordingly, the first high voltage VGH1 supplied from the first high voltage supply can be output to the first output terminal OUT1 through the second switch SW2 and the third switch SW3, and thereby, the first initialization voltage Dvini[n] can have the first voltage level V1. Further, the second high voltage VGH2 supplied from the second high voltage supply can be output to the second output terminal OUT2 through the sixth switch SW6, and thereby, the n-th carry signal Carry_Dvini[n] can have the high level.

In a fourth period T14, the (n−1)th carry signal Carry_Dvini[n−1] and the clock signal GCLK[n] may have the high level may have the low levels, the (n+2)th carry signal Carry_Dvini[n+2] may have a high level. The second switch SW2, the sixth switch SW6, and the ninth switch SW9 can be off, and the first switch SW1, the fifth switch SW5, the seventh switch SW7, and the tenth switch SW10 can be on, by the (n−1)th carry signal Carry_Dvini[n−1] and the clock signal CCLK[n]. The third switch SW3 can be off, and the fourth switch SW4 can be on, by the (n+2)th carry signal Carry_Dvini[n+2] having the high level. The eighth switch SW8 can be on.

Accordingly, although the first low voltage VGL1 supplied from the first low voltage supply is transmitted to the output node No through the first switch SW1, since the third switch SW3 is off, the first low voltage VGL1 cannot be output to the first output terminal OUT1. However, since the fourth switch SW4 is on, the driving voltage VDD can be transmitted to the first output terminal OUT1 through the fourth switch SW4, and thereby, the first initialization voltage Dvini[n] can have a third voltage level V3, which is the voltage level of the driving voltage VDD. Further, the second low voltage VGL2 supplied from the second low voltage supply can be output to the second output terminal OUT2 through the fifth switch SW5, and thereby, the n-th carry signal Carry_Dvini[n] can be output with the low level.

In a fifth period T15, the (n−1)th carry signal Carry_Dvini[n−1] may have the low level, and the clock signal GCLK[n] and the (n+2)th carry signal Carry_Dvini[n+2] may have the high levels. The second switch SW2, the sixth switch SW6, the seventh switch SW7, and the ninth switch SW9 can be off, and the first switch SW1, the fifth switch SW5, the tenth switch SW10, the eleventh switch SW11 can be on, by the (n−1)th carry signal Carry_Dvini[n−1] and the clock signal GCLK[n]. The third switch SW3 can be off, and the fourth switch SW4 can be on, by the (n+2)th carry signal Carry_Dvini[n+2] having the high level. The eighth switch SW8 can be on.

Accordingly, the first low voltage VGH1 supplied from the first low voltage supply can be transmitted to the output node No through the first switch SW1. However, since the third switch SW3 is off, the first low voltage VGL1 cannot be output through the first output terminal OUT1. However, since the fourth switch SW4 is on, the driving voltage VDD can be transmitted to the first output terminal OUT1 through the fourth switch SW4, and thereby, the first initialization voltage Dvini[n] can have the third voltage level V3, which is the voltage level of the driving voltage VDD. Further, the second low voltage VGL2 supplied from the second low voltage supply can be output to the second output terminal OUT2 through the fifth switch SW5, and thereby, the n-th carry signal Carry_Dvini[n] can be output with the low level.

As described above, the n-th carry signal Carry_Dvini[n] has the second voltage level V2 in the first period T11, the first voltage level V1 in the second period T12 and the third period T13, and the third voltage level V3 in the fourth period T14 and the fifth period T15. When the fifth period T15 passes, the n-th carry signal Carry_Dvini[n] has the second voltage level V2 again.

Accordingly, the n-th first initialization voltage Dvini[n] has voltage levels between the first voltage level V1 and the second voltage level V2, and is lowered stepwise in the order of the first voltage level V1, the third voltage level V3, and the second voltage level V2. Further, by configuring the reset period Tr and a period in which the n-th first initialization voltage Dvini[n] has the third voltage level V3 to overlap each other, after the second on-bias period OBS2, the second node N2 and the third node N3 of the pixel can be reset to the n-th first initialization voltage Dvini[n] having the third voltage level V3.

Further, in the n-th stage 1302, in the first period T11, the n-th first initialization voltage Dvini[n] can be output with the first voltage level V1 corresponding to a high voltage according to the voltage of the Q node Q and the voltage of the QB node QB; in the second period T12, the n-th first initialization voltage Dvini[n] can be output with the third voltage level V3 corresponding to the driving voltage VDD according to the voltage of the Q node Q and the voltage of the QB node QB; and in the third period T13, the n-th first initialization voltage Dvini[n] can be output with the second voltage level V2 according to the voltage of the Q node Q and the voltage of the QB node QB. For example, when the voltage of the Q node Q has a positive voltage, the voltage of the QB node QB may have a negative voltage, and when the voltage of the Q node Q has a negative voltage, the voltage of the QB node QB may have a positive voltage.

The above description has been presented to enable any person skilled in the art to make and use the technical idea of the present invention, and has been provided in the context of a particular application and its requirements. Various modifications, additions and substitutions to the described embodiments will be readily apparent to those skilled in the art, and the general principles defined herein may be applied to other embodiments and applications without departing from the spirit and scope of the present invention. The above description and the accompanying drawings provide an example of the technical idea of the present invention for illustrative purposes only. That is, the disclosed embodiments are intended to illustrate the scope of the technical idea of the present invention. Thus, the scope of the present invention is not limited to the embodiments shown, but is to be accorded the widest scope consistent with the claims. The scope of protection of the present invention should be construed based on the following claims, and all technical ideas within the scope of equivalents thereof should be construed as being included within the scope of the present invention.

What is claimed is:

1. A display device comprising:

a display panel that comprises a plurality of gate lines, a plurality of data lines, a plurality of first initialization power lines, a plurality of power lines, and a plurality of pixels connected to the plurality of gate lines, the plurality of data lines, the plurality of first initialization power lines, and the plurality of power lines, the plurality of pixels configured to emit light during a light emission period of the display device;

a data driving circuit configured to supply data signals to the plurality of data lines;

a gate driving circuit configured to supply gate signals to the plurality of gate lines;

a first power supply circuit configured to supply a first initialization voltage having a voltage level that changes between a first voltage level and a second voltage level to the plurality of first initialization power lines; and a second power supply circuit configured to supply a pixel driving voltage to a plurality of pixel driving power lines among the plurality of power lines, wherein at least one pixel of the plurality of pixels comprises:

a driving transistor for enabling a driving current to flow from a second node to a third node in response to a voltage of a first node to which a voltage corresponding to a data signal is applied; and a light emitting element for emitting light in response to the driving current, and wherein while the light emitting element does not emit the light prior to the light emission period, the voltage corresponding to the data signal is applied to the first node, and thereafter, the second node and the third node are initialized using the first initialization voltage, the first initialization voltage having the first voltage level in a first period, a third voltage level between the first voltage level and the second voltage level in a second period that is subsequent the first period, and the second voltage level in a third period that is subsequent the second period.

2. The display device according to claim 1, wherein the at least one pixel generates the driving current in response to the pixel driving voltage and the voltage of the first node, and the third voltage level of the first initialization voltage matches a voltage level of the pixel driving voltage.

3. The display device according to claim 1, wherein the at least one pixel further comprising:

a first transistor connected between the first node and the third node, the first transistor turned on in response to a first gate signal;

a second transistor connected between a data line from the plurality of data lines and the second node, the second transistor turned on in response to a second gate signal;

a third transistor connected between the second node and the pixel driving power line that is connected to a pixel driving power supply, the third transistor turned on in response to an emission signal;

a fourth transistor connected between the third node and an anode electrode of the light emitting element, the fourth transistor turned on in response to the emission signal;

a fifth transistor disposed between the third node and a first initialization voltage line that transmits the first initialization voltage, the fifth transistor turned on in response to a third gate signal; and a storage capacitor connected between the first node and the pixel driving power line.

4. The display device according to claim 3, wherein in response to the third gate signal, the fifth transistor is turned on before the data signal is applied to the first node and the fifth transistor is turned on after the data signal is applied to the first node, wherein while the data signal is applied to the first node the first transistor is turned off.

5. The display device according to claim 3, wherein the pixel further comprises:

a sixth transistor disposed between the anode electrode of the light emitting element and a second initialization power line that applies a second initialization voltage to the anode electrode of the light emitting element while the sixth transistor is turned on, the sixth transistor turned on in response to the third gate signal.

6. The display device according to claim 1, wherein the first power supply circuit comprises a plurality of stages, each of the plurality of stages configured to receive a first high voltage having the first voltage level, a first low voltage having the second voltage level, and a driving voltage having the third voltage level, and supply the first initialization voltage such that the first initialization voltage sequentially has the first voltage level, the third voltage level, and the second voltage level.

7. The display device according to claim 6, wherein the first initialization voltage comprises an (n−1)th first initialization voltage, an n-th first initialization voltage, an (n+1)-th first initialization voltage, and an (n+2)-th first initialization voltage, which are sequentially output, wherein the plurality of stages comprises an (n−1)th stage configured to output an (n−1)th carry signal and the (n−1)th first initialization voltage, an n-th stage configured to output an n-th carry signal and the n-th first initialization voltage, an (n+1)-th stage configured to output an (n+1)-th carry signal and the (n+1)-th first initialization voltage, and an (n+2) stage configured to output an (n+2)-th carry signal and the (n+2)-th first initialization voltage, wherein the n-th stage is configured to receive the (n−1)th carry signal and the (n+2)-th carry signal, and to output the n-th carry signal and the n-th first initialization voltage, and wherein the outputting of the n-th first initialization voltage is performed such that the n-th first initialization voltage having the first voltage level is output in response to the (n−1)th carry signal in the first period, and the n-th first initialization voltage having the third voltage level corresponding to the driving voltage is output in response to the (n+2)-th carry signal in the second period.

8. The display device according to claim 7, wherein the n-th stage is configured to operate such that in the first period, the n-th first initialization voltage is output with the first voltage level corresponding to the first high voltage according to a voltage of a Q node and a voltage of a QB node, in the second period, the n-th first initialization voltage is output with the third voltage level corresponding to the driving voltage according to the voltage of the Q node and the voltage of the QB node, and in the third period, the n-th first initialization voltage is output with the second voltage level corresponding to the first low voltage according to the voltage of the Q node and the voltage of the QB node.

9. The display device according to claim 7, wherein the n-th stage comprises:

a first switch that includes a first electrode of the first switch, a second electrode of the first switch, and a gate electrode of the first switch, which are respectively connected to a first low voltage supply that supplies the first low voltage, an output node, and a Q node, and the first switch is configured to apply the first low voltage to a first output node by a voltage of the Q node according to the (n−1)th carry signal;

a second switch that includes a first electrode of the second switch, a second electrode of the second switch, and a gate electrode of the second switch, which are respectively connected to a first high voltage supply that supplies a first high voltage, the output node, and a QB node, and the second switch is configured to apply the first high voltage to the output node by a voltage of the QB node according to the (n−1)th carry signal;

a third switch that includes a first electrode of the third switch, a second electrode of the third switch, and a gate electrode of the third switch, which are respectively connected to the output node, a first output terminal, and a carry signal line through which the (n+2)-th carry signal is supplied;

a fourth switch that includes a first electrode of the fourth switch, a second electrode of the fourth switch, and a gate electrode of the fourth switch, which are respectively connected to a driving power supply that supplies the driving voltage, the first output terminal, and the carry signal line through which the (n+2)-th carry signal is supplied, and the fourth switch configured to be turned on while the third switch is turned off and turned off while the third switch is turned on;

a fifth switch that includes a first electrode of the fifth switch, a second electrode of the fifth switch, and a gate electrode of the fifth switch, which are respectively connected to a second low voltage supply that supplies a second low voltage, a second output terminal, and the output node; and a sixth switch that includes a first electrode of the sixth switch, a second electrode of the sixth switch, and a gate electrode of the sixth switch, which are respectively connected to a second high voltage supply that supplies a second high voltage, the second output terminal, and the QB node.

10. The display device according to claim 9, wherein the fourth switch receives the (n+2)-th carry signal through an inverter.

11. The display device according to claim 9, wherein the third switch comprises a P-type metal oxide semiconductor (MOS) transistor, and the fourth switch comprises an N-type MOS transistor.

12. The display device according to claim 1, wherein the display panel comprises:

a display area comprising a first optical area including a first plurality of light emitting areas and a plurality of transmission areas, and a normal area located outside of the first optical area and including a second plurality of light emitting areas;

a non-display area; and a first optical electronic device located on a rear surface or a lower portion of the display panel, the first optical electronic device overlapping at least a portion of the first optical area included in the display area.

13. A power supply device comprising:

a plurality of stages configured to generate a first initialization voltage and a carry signal that are sequentially output by each of the plurality of stages, wherein the first initialization voltage output from each of the plurality of stages has a voltage level between a first voltage level and a second voltage level, and has the first voltage level in a first period, a third voltage level between the first voltage level and the second voltage level in a second period that is subsequent the first period, and the second voltage level in a third period that is subsequent the second period.

14. The power supply device according to claim 13, wherein the first initialization voltage comprises an (n−1)th first initialization voltage, an n-th first initialization voltage, an (n+1)-th first initialization voltage, and an (n+2)-th first initialization voltage, which are sequentially output, wherein the plurality of stages comprises an (n−1)th stage configured to output an (n−1)th carry signal and the (n−1)th first initialization voltage, an n-th stage configured to output an n-th carry signal and the n-th first initialization voltage, an (n+1)-th stage configured to output an (n+1)-th carry signal and the (n+1)-th first initialization voltage, and an (n+2) stage configured to output an (n+2)-th carry signal and the (n+2)-th first initialization voltage, wherein the n-th stage is configured to receive the (n−1)th carry signal and the (n+2)-th carry signal, and to output the n-th carry signal and the n-th first initialization voltage, and wherein the outputting of the n-th first initialization voltage is performed such that the n-th first initialization voltage having the first voltage level is output in response to the (n−1)th carry signal in the first period, and the n-th first initialization voltage having the third voltage level corresponding to a driving voltage is output in response to the (n+2)-th carry signal in the second period.

15. The power supply device according to claim 14, wherein the n-th stage is configured to operate such that in the first period, the n-th first initialization voltage is output with the first voltage level corresponding to a high voltage according to a voltage of a Q node and a voltage of a QB node, in the second period, the n-th first initialization voltage is output with the third voltage level corresponding to the driving voltage according to the voltage of the Q node and the voltage of the QB node, in the third period, the n-th first initialization voltage is output with the second voltage level according to the voltage of the Q node and the voltage of the QB node.

16. The power supply device according to claim 14, wherein the n-th stage comprises:

a first switch that includes a first electrode of the first switch, a second electrode of the first switch, and a gate electrode of the first switch, which are respectively connected to a first low voltage supply that supplies a first low voltage, an output node, and a Q node, and the first switch is configured to apply the first low voltage to a first output node by a voltage of the Q node according to the (n−1)th carry signal;

a second switch that includes a first electrode of the second switch, a second electrode of the second switch, and a gate electrode of the second switch, which are respectively connected to a first high voltage supply that supplies a first high voltage, the output node, and a QB node, and the second switch is configured to apply the first high voltage to the output node by a voltage of the QB node according to the (n−1)th carry signal;

a third switch that includes a first electrode of the third switch, a second electrode of the third switch, and a gate electrode of the third switch, which are respectively connected to the output node, a first output terminal, and a carry signal line through which the (n+2)-th carry signal is supplied;

a fourth switch that includes a first electrode of the fourth switch, a second electrode of the fourth switch, and a gate electrode of the fourth switch, which are respectively connected to a driving power supply that supplies the driving voltage, the first output terminal, and the carry signal line through which the (n+2)-th carry signal is supplied, and the fourth switch configured to be turned on while the third switch is turned off and turned off while the third switch is turned on;

a fifth switch that includes a first electrode of the fifth switch, a second electrode of the fifth switch, and a gate electrode of the fifth switch, which are respectively connected to a second low voltage supply that supplies a second low voltage, a second output terminal, and the output node; and a sixth switch that includes a first electrode of the sixth switch, a second electrode of the sixth switch, and a gate electrode of the sixth switch, which are respectively connected to a second high voltage supply that supplies a second high voltage, the second output terminal, and the QB node, wherein the fourth switch receives the (n+2)-th carry signal through an inverter, and wherein the third switch comprises a P-type metal oxide semiconductor (MOS) transistor, and the fourth switch comprises an N-type MOS transistor.

17. The power supply device according to claim 14, wherein the first initialization voltage is applied to a second node and a third node of a driving transistor included in a pixel to initialize the second node and the third node while a light emitting element that is included in the pixel does not emit light prior to a light emission period of the pixel, the second node of the driving transistor is configured to be electrically connected between a data line to which a data signal is applied and a pixel driving voltage, and the third node of the driving transistor is electrically connected to the light emitting element, wherein the first node and the second node are initialized after a voltage corresponding to the data signal is applied to a first node of the driving transistor.

18. A pixel comprising:

a driving transistor including a first node, a second node that is configured to be electrically connected between a data line to which a data signal is applied and a pixel driving line to which a pixel driving voltage is applied, and a third node, the driving transistor configured to enable a driving current to flow from the second node to the third node responsive to the data signal being applied to the first node; and a light emitting element electrically connected to the third node of the driving transistor, the light emitting element configured to emit light responsive to the driving current, wherein after the data signal is applied to the first node of the driving transistor, a first initialization voltage is applied to the second node and the third node of the driving transistor to initialize the second node and the third node while the light emitting element does not emit light prior to a light emission period of the pixel, the first initialization voltage having a first voltage level in a first period, a third voltage level between the first voltage level and a second voltage level in a second period that is subsequent the first period, and the second voltage level in a third period that is subsequent the second period.

19. The pixel according to claim 18, wherein the first voltage level of the first initialization voltage is greater than pixel driving voltage, the third voltage level of the first initialization voltage substantially matches the pixel driving voltage, and the second voltage level is less than the third voltage level.

20. The pixel according to claim 18, further comprising:

a first transistor connected between the first node and the third node, the first transistor turned on in response to a first gate signal;

a second transistor connected between the data line and the second node, the second transistor turned on in response to a second gate signal;

a third transistor connected between the second node and the pixel driving power line, the third transistor turned on in response to an emission signal;

a fourth transistor connected between the third node and an anode electrode of the light emitting element, the fourth transistor turned on in response to the emission signal to electrically connect the driving transistor to the light emitting element;

a fifth transistor disposed between the third node and a first initialization voltage line that transmits the first initialization voltage, the fifth transistor turned on in response to a third gate signal; and a storage capacitor connected between the first node and the pixel driving power line.

* * * * *